US008128210B2

(12) United States Patent
Seino et al.

(10) Patent No.: US 8,128,210 B2
(45) Date of Patent: Mar. 6, 2012

(54) FLUID EJECTING APPARATUS AND FLUID FILLING METHOD OF FLUID EJECTING APPARATUS

(75) Inventors: Takeo Seino, Shiojiri (JP); Taro Takekoshi, Shiojiri (JP); Norihisa Kobayashi, Shiojiri (JP); Noritsuna Rokuhara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 400 days.

(21) Appl. No.: 12/176,771

(22) Filed: Jul. 21, 2008

(65) Prior Publication Data

US 2009/0021564 A1 Jan. 22, 2009

(30) Foreign Application Priority Data

Jul. 20, 2007 (JP) ..... 2007-189068
Jul. 20, 2007 (JP) ..... 2007-189075
Dec. 10, 2007 (JP) ..... 2007-318034

(51) Int. Cl.
*B41J 2/175* (2006.01)

(52) U.S. Cl. ..... 347/85; 347/84; 347/86

(58) Field of Classification Search ..... 347/84–86
See application file for complete search history.

(56) References Cited

U.S. PATENT DOCUMENTS 6,273,103 B1 * 8/2001 Enz et al. ..... 134/22.11
7,334,883 B2 * 2/2008 Campillo et al. ..... 347/84
7,367,663 B2 * 5/2008 Matsumoto ..... 347/86
7,387,377 B2 * 6/2008 Yoshino et al. ..... 347/85
7,681,967 B2 * 3/2010 Silverbrook et al. ..... 347/7
7,699,449 B2 * 4/2010 Yoshino et al. ..... 347/85
7,780,276 B2 * 8/2010 Guhse et al. ..... 347/85

FOREIGN PATENT DOCUMENTS

| | | |
|---|---|---|
| JP | 05-116339 | 5/1993 |
| JP | 2002-283590 | 10/2002 |
| JP | 2004-114647 | 4/2004 |
| JP | 2005-047258 | 2/2005 |
| JP | 2007-083640 | 4/2007 |
| JP | 2007-160916 | 6/2007 |

* cited by examiner

*Primary Examiner* — Ryan Lepisto
*Assistant Examiner* — Guy Anderson
(74) *Attorney, Agent, or Firm* — Workman Nydegger

(57) ABSTRACT

A fluid ejecting apparatus includes a fluid containing portion, a fluid discharging portion, a flow passage forming portion and a valve mechanism. The fluid containing portion contains fluid. The fluid discharging portion discharges the fluid. The flow passage forming portion forms a fluid flow passage that extends from the fluid containing portion to the fluid discharging portion. The valve mechanism is able to open or close the fluid flow passage. The fluid ejecting apparatus is placed in an initial state before an initial use of the fluid ejecting apparatus, wherein fluid is contained in the fluid containing portion and at least portion of the fluid flow passage from a position of the fluid containing portion to a position of the valve mechanism is filled with the fluid and the fluid flow passage is closed by the valve mechanism.

17 Claims, 23 Drawing Sheets

FLUID EJECTING APPARATUS AND FLUID FILLING METHOD OF FLUID EJECTING APPARATUS

CROSS REFERENCES TO RELATED APPLICATIONS

The entire disclosure of Japanese Patent Application No. 2007-189068, filed Jul. 20, 2007, Japanese Patent No. 2007-189075, filed Jul. 20, 2007, and Japanese Patent No. 2007-318034, filed Dec. 10, 2007 are expressly incorporated herein by reference.

BACKGROUND OF THE INVENTION

1. Technical Field

The present invention relates to a fluid ejecting apparatus. More specifically, the present invention relates to a system and method for supplying fluid within a fluid ejecting apparatus.

2. Related Art

One example of a fluid ejection apparatus currently known in the art is an ink jet printer which includes a recording head which is filled with an ink or a preservative solution during the manufacturing process, such as in the apparatuses described in JP-A-2002-283590 and JP-A-2004-114647, which are referred to as off-carriage printers.

In another configuration currently known in the art, the fluid ejecting apparatus is an ink jet printer wherein an ink container that contains ink is arranged separately from the recording head. One example of such a configuration is described in JP-A-2005-47258.

When an ink jet printer is manufactured with a recording head filled with ink, or the like, it may be necessary to refill the ink in the recording head after a number of printing processes have been performed. This is particularly true in instances where the printer is an off-carriage printer, because the amount of ink that is needed to flow from the ink container to the recording head is relatively large. When a printer is manufactured without an attached ink container, an additional member is needed to seal the area where the supply needle that supplies the ink from the ink container is required.

In addition, when the printer is manufactured without an attached ink container, the quality of ink in the recording head may possibly deteriorate because air may be allowed to enter the ink flow passage or the ink container.

These problems not only apply to ink jet printers including ink containers that contain liquid ink and recording head that discharges liquid ink, but also apply to all fluid ejecting apparatuses that include a fluid containing portion that contains fluid and a fluid discharge portion that discharges fluid.

BRIEF SUMMARY OF THE INVENTION

An advantage of some aspects of the invention is that makes it possible to suppress entry of foreign matter into a fluid containing portion in a fluid ejecting apparatus before the apparatus is used.

Aspects of the invention may be implemented as the following embodiments or application examples.

A first embodiment of the invention is a fluid ejecting apparatus includes a fluid containing portion, a fluid discharging portion, a flow passage forming portion and a valve mechanism. The fluid containing portion contains fluid. The fluid discharging portion discharges the fluid. The flow passage forming portion forms a fluid flow passage that extends from the fluid containing portion to the fluid discharging portion. The valve mechanism is able to open or close the fluid flow passage. The fluid ejecting apparatus is placed in an initial state before the fluid ejecting apparatus is used, wherein the fluid is filled in the fluid containing portion, at least a portion of the fluid flow passage from the fluid containing portion to the valve mechanism is filled with the fluid, and the fluid flow passage is closed by the valve mechanism.

Another aspect of the invention provides a method of filling fluid in a fluid ejecting apparatus. The fluid ejecting apparatus includes a fluid containing portion that contains the fluid, a fluid discharging portion that discharges the fluid, a flow passage forming portion that forms a fluid flow passage that extends from the fluid containing portion to the fluid discharging portion, a valve mechanism that is able to open or close the fluid flow passage, and a vacuum device that vacuums the inside of the fluid flow passage. The method includes closing the fluid flow passage using the valve mechanism, generating a negative pressure in the fluid flow passage from the fluid discharging portion to the valve mechanism by performing a vacuuming operation with the vacuum device, opening the fluid flow passage using the valve mechanism, and closing the fluid flow passage by the valve mechanism after the fluid contained in the containing portion fills the fluid flow passage from the containing portion to the valve mechanism.

Note that the aspects of the invention may be implemented in various forms. For example, the aspects of the invention may be implemented in a fluid ejecting apparatus, a fluid discharging apparatus, a printing apparatus, a method of manufacturing these apparatuses, a method of filling fluid to these apparatuses, and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described in the following order using the following exemplary embodiments.

A. First Embodiment
B. Second Embodiment
C. Third Embodiment
D. Alternative Embodiment

A. First Embodiment

Figure 1:
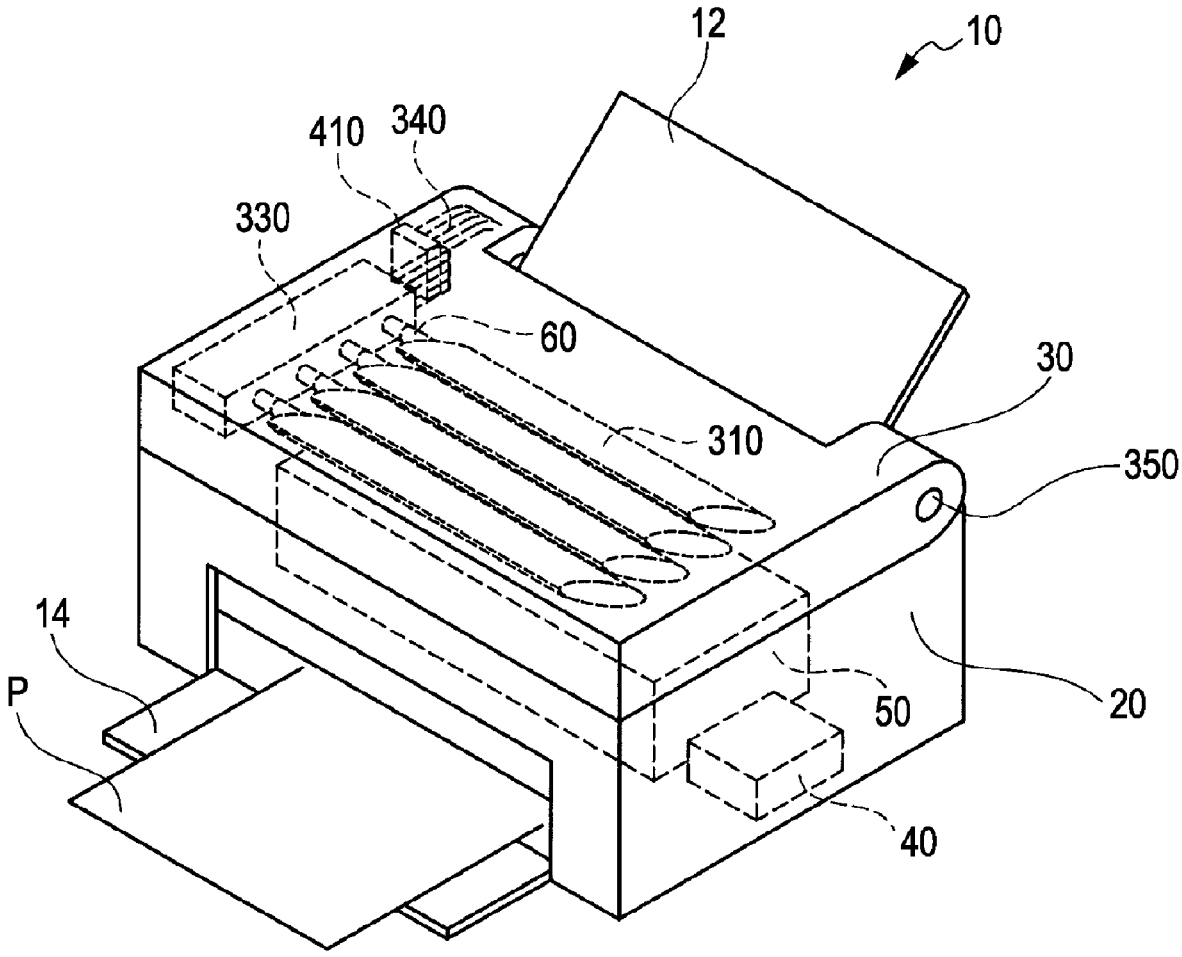
FIG. 1 is a perspective view that illustrates the configuration of a printer, which serves as a fluid ejecting apparatus, according to a first embodiment of the invention.

FIG. 1 is a perspective view that illustrates the configuration of a printer 10, which serves as an example of fluid ejecting apparatus capable of being used in association with the present invention. The printer 10 is a first embodiment of the invention. The printer 10 is an ink jet printer that prints characters or figures by ejecting liquid ink, comprising a fluid, onto a print sheet P, which serves as a recording medium.

The printer 10 includes a main housing 20 that accommodates a print mechanism portion 50. The main housing 20 is provided with a paper feed tray 12 and a paper output tray 14. The paper feed tray 12 introduces a print sheet P, which is supplied to the print mechanism portion 50, into the main housing 20. The paper output tray 14 delivers a print sheet P, which is ejected from the print mechanism portion 50, outward from the main housing 20. The details of the print mechanism portion 50 will be described more fully below.

A control portion 40 is accommodated in the main housing 20 and is capable of controlling portions of the printer 10. In the present embodiment, the control portion 40 includes application specific integrated circuits (ASIC) that include the hardware, such as a central processing unit (CPU), a read only memory (ROM), and a random access memory (RAM). The control portion 40 has installed software that implements various functions of the printer 10.

An upper housing 30 is arranged on the upper face of the main housing 20. The upper housing is an accommodation case that accommodates a plurality of ink packs 310. The upper housing 30 is coupled to the main housing 20 so as to pivot about a rotation shaft 350. The plurality of ink packs 310, which serve as ink supply sources, contain liquid inks of a variety of different colors.

In the present embodiment, each ink pack 310 is formed of a flexible, substantially rectangular oblate bag having a substantially elliptical cross section. Each ink pack 310 has a pack port 60 provided at one side. Ink may be delivered through the pack port 60. In the present embodiment, the plurality of ink packs 310 are held so that one side of each of the ink packs 310 is raised and the ink packs 310 are obliquely stacked. In the present embodiment, four ink packs 301 corresponding to four colors of ink, that is, black, cyan, magenta, and yellow, are accommodated in the upper housing 30. Note that the number of ink packs 310 or the color of ink contained in each ink pack 310 may be modified. For example, six ink packs 310 corresponding to six colors of ink, including light cyan and light magenta may be provided in addition to the above four colors in the upper housing 30.

The upper housing 30 is provided with an ink supply portion 330 to which the pack port 60 of each ink pack 310 is connected. A supply tube 340 is connected to the ink supply portion 330. The supply tube 340 leads ink, which is delivered from the ink packs 310 to the ink supply portion 330, to the print mechanism portion 50. The supply tube 340 internally comprises four tubular flow passages which correspond to the four ink packs 310. The ink supply portion 330 and the supply tube 340 cooperatively form part of an ink flow passage that extends from the ink packs 310 to a recording head 810 of the print mechanism portion 50, which will be described more fully below.

The supply tube 340 has a coupling 410. A portion of the supply tube 340 has a curved portion as described more fully below, so that the portion is formed of a material having a relatively higher flexibility, such as a polyethylene-based elastomer. In addition, another portion of the supply tube 340 may be formed of a material having a relatively low flexibility, such as polypropylene.

Figure 2:
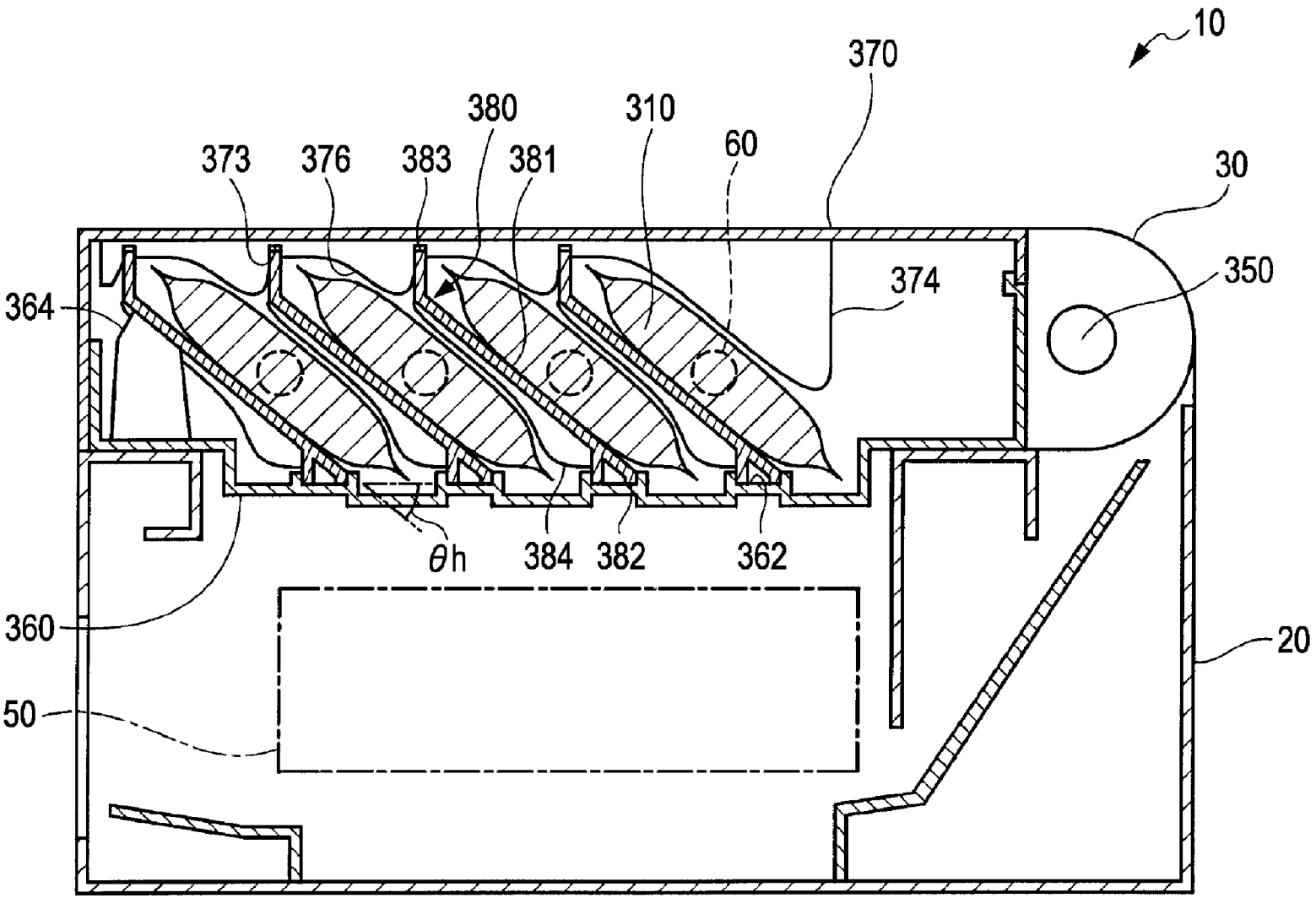
FIG. 2 is a cross-sectional view that illustrates the configuration of the printer with a closed upper housing.
Figure 3:
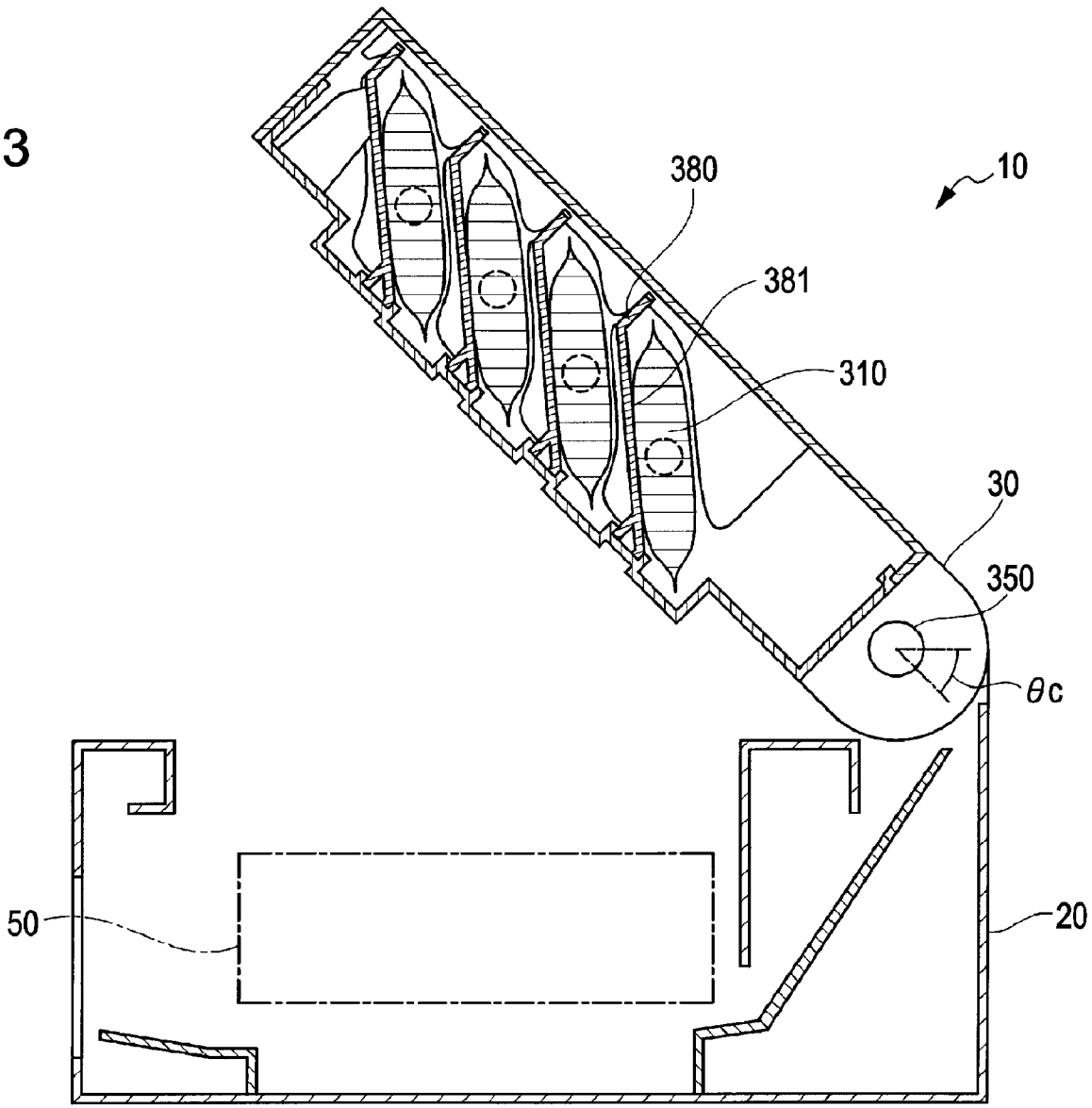
FIG. 3 is a cross-sectional view that illustrates the configuration of the printer with an opened upper housing.

FIG. 2 is a cross-sectional view that illustrates the configuration of the printer 10 when the upper housing 30 is closed. FIG. 3 is a cross-sectional view that illustrates the configuration of the printer 10 when the upper housing 30 is open. As shown in FIG. 3, the upper housing 30 is coupled to the main housing 20 so as to rotate about the rotation shaft 350. When the upper housing 30 is opened, the upper portion of the print mechanism portion 50 that is accommodated in the main housing 20 is exposed. Thus, the printer 10 of the present embodiment is able to use the upper housing 30 acts as a cover for the print mechanism portion 50, which also accommodates the ink packs 310 and improves the flexibility of positions where the ink packs 310 may be arranged. This allows easy maintenance of the print mechanism portion 50 within the main housing 20.

As shown in FIG. 2 and FIG. 3, the upper housing 30 includes a lower housing portion 360 and an upper housing portion 370. The lower housing portion 360 constitutes the inner bottom portion of the upper housing 30. The upper housing portion 370 constitutes the inner top portion of the upper housing 30. A plurality of holder guides 362 are disposed in the bottom of the lower housing portion 360. The holder guides 362 are arranged substantially parallel to the rotation shaft 350 and are spaced at substantially equal intervals.

A plurality of holders 380 are provided inside the upper housing 30, and comprise holders for the ink packs 310. Each holder 380 includes an inclined plate 381 that is inclined with respect to the holder guide 362. The ink pack 310 is mounted on the upper surface of the inclined plate 381 of each holder 380 so that the one of the surfaces of the oblate bag portion of the ink pack 310 is in contact with the upper surface of the inclined plate 381. In the present embodiment, at least portion of the surface of each ink pack 310, which contacts the inclined plate 381 of the holder 380, is adhered to the inclined plate 381 of the holder 380 with double-stick tape. A base portion 382 is formed on the lower side of the inclined plate 381 in each holder 380. The base portion 382 is insertable in the holder guide 362. The base portion 382 of each holder 380, once inserted in the holder guide 362, is fixedly fastened to the lower housing portion 360 with fixation screws 388 and 389, which serve as fastening members, as described more fully below. The plurality of holders 380 are arranged parallel to one another at intervals along the inner bottom portion of the lower housing portion 360 so that the inclined plate 381 of one holder 380 is located above the ink pack 310 mounted on the adjacent holder 380. As shown in FIG. 2 and FIG. 3, the inclined plate 381 of each holder 380 is inclined with respect to the holder guide 362 of the lower housing portion 360 at an inclination angle θh. In the present embodiment, a movable angle θc within which the upper housing 30 may be opened or closed about the rotation shaft 350 is about 45 degrees, whereas the inclination angle θh of the inclined plate 381 with respect to the holder guide 362 is about 40 degrees.

In this way, in the present embodiment, because each of the ink packs 310 is mounted on a corresponding one of the inclined plates 381 of the holders 380, the plurality of ink packs 310 may be overlappingly accommodated with high efficiency while preventing the weight of the ink pack 310 from being exerted on the adjacent ink pack 310. In addition, because the ink packs 310 are held from below, regardless of whether the upper housing 30 is opened or closed, it is possible to prevent the ink packs 310 from being excessively pressed against the abutting holders 380 by their own weight.

As shown in FIG. 2, a plate-like back face support rib 384 is provided on the back face of the inclined plate 381 of each holder 380 and is formed along the ink pack 310 mounted on the adjacent holder 380. A plate-like holder support rib 364 extends vertically from the inner bottom portion of the lower housing portion 360 toward the lower side of the inclined plate 381 of the holder 380 located at an end of the side of the lower housing portion 360 where the inclined plate 381 is inclined among the plurality of parallel arranged holders 380. In the present embodiment, the upper portion of the holder support rib 364 contacts the back face of the inclined plate 381 of the holder 380 in order to reinforce the holder 380 against a force that is exerted in the direction that the inclined plate 381 is inclined. A plate-like end portion support rib 374 is provided on the inner top portion of the upper housing portion 370. The end portion support rib 374 is formed along the upper portion of the ink pack 310 mounted on the holder 380 at the opposite to and inclined plate 381. Using the end portion support rib 374, it is possible to suppress the ink pack 310, which is mounted on the holder 380, from being excessively deformed. Plate-like intermediate support ribs 376 are provided on the inner top portion of the upper housing portion 370. Each of the intermediate support ribs 376 is formed between two adjacent holders 380. Using the intermediate support ribs 376, it is possible to suppress the upper portions of the ink packs 310, which are not supported by the inclined plates 381 of the abutting holders, and prevent the ink packs 310 from being excessively deformed. Engaging portions 373 are provided on the inner top portion of the upper housing portion 370. Each of the engaging portions 373 engages the upper end portion 383 of the inclined plate 381 of the holder 380. Using the engaging portions 373, it is possible to keep the holders 380 from being excessively deformed.

As shown in FIG. 2 and FIG. 3, the bottom portion (lower housing portion 360) of the upper housing 30 is formed so that portions, where the ink packs 310 are provided, protrude downward. In this manner, it is possible to increase the space inside the upper housing 30 for providing the ink packs 310. Note that, because the printer 10 of the present embodiment is a so-called off-carriage printer wherein a container (ink pack 310) that contains ink is arranged separately from the carriage 80 (see FIG. 6) of the print mechanism portion 50. The height of the print mechanism portion 50 may be smaller than a so-called on-carriage printer where an ink container is arranged on the carriage. Thus, according to the printer 10 of the present embodiment, a portion of the lower housing portion 360 may be formed so as to protrude downward into the printer 10 without interfering with the print mechanism portion 50. Thus, the housing of the existing on-carriage printer 10 that is, for example, provided with a scanner mechanism at a portion corresponding to the upper housing 30 may also be used as the housing of the printer 10 of the present embodiment with only a slight modification.

Figure 4:
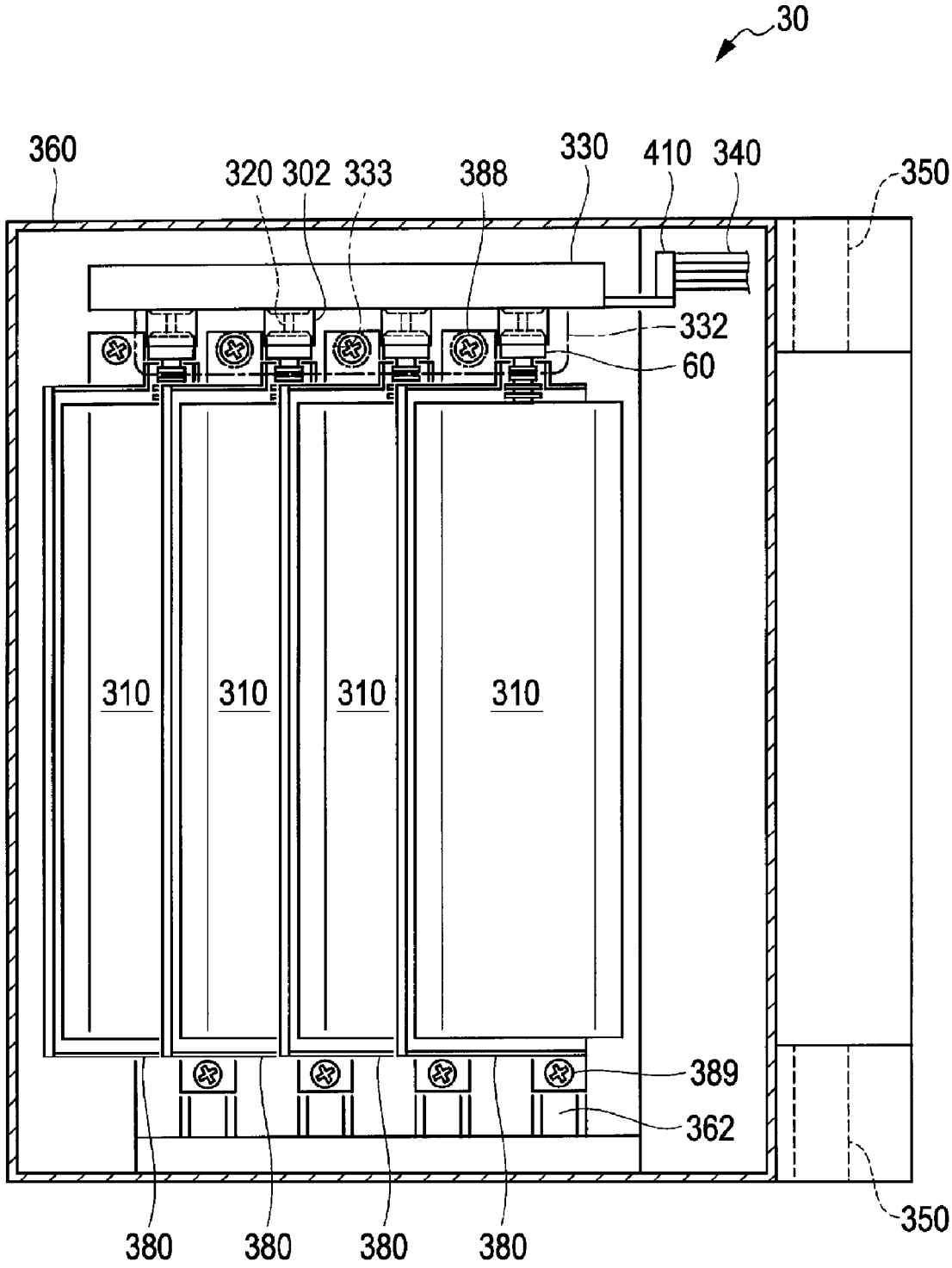
FIG. 4 is a top view that illustrates the internal configuration of the upper housing.

FIG. 4 is a top view that illustrates the internal configuration of the upper housing 30. As shown in FIG. 4, the four holders 380 on which the ink packs 310 are mounted are provided so as to overlap each other in the upper housing 30 and each are fixed to the lower housing portion through the fixation screws 388 and 389. The pack port 60 of each ink pack 310 is located inside a guide portion of the ink supply portion 330, and a supply needle 320 is inserted in each pack port 60. Insertion of the supply needles 320 into the pack ports 60 opens ink flow passages from the ink packs 310 to the supply tube 340 in the ink supply portion 330. Note that a guard plate 332 (indicated by the dashed line) is provided at the ink supply portion and covers the upper side of the connecting portions where the ink supply portion 330 is connected with the pack ports 60 of the ink packs 310. The guard plate 332 is formed with openings 333 that allow insertion of a tool for fastening the fixation screws 388 which fix the holders 380 to the lower housing portion 360.

Figure 5:
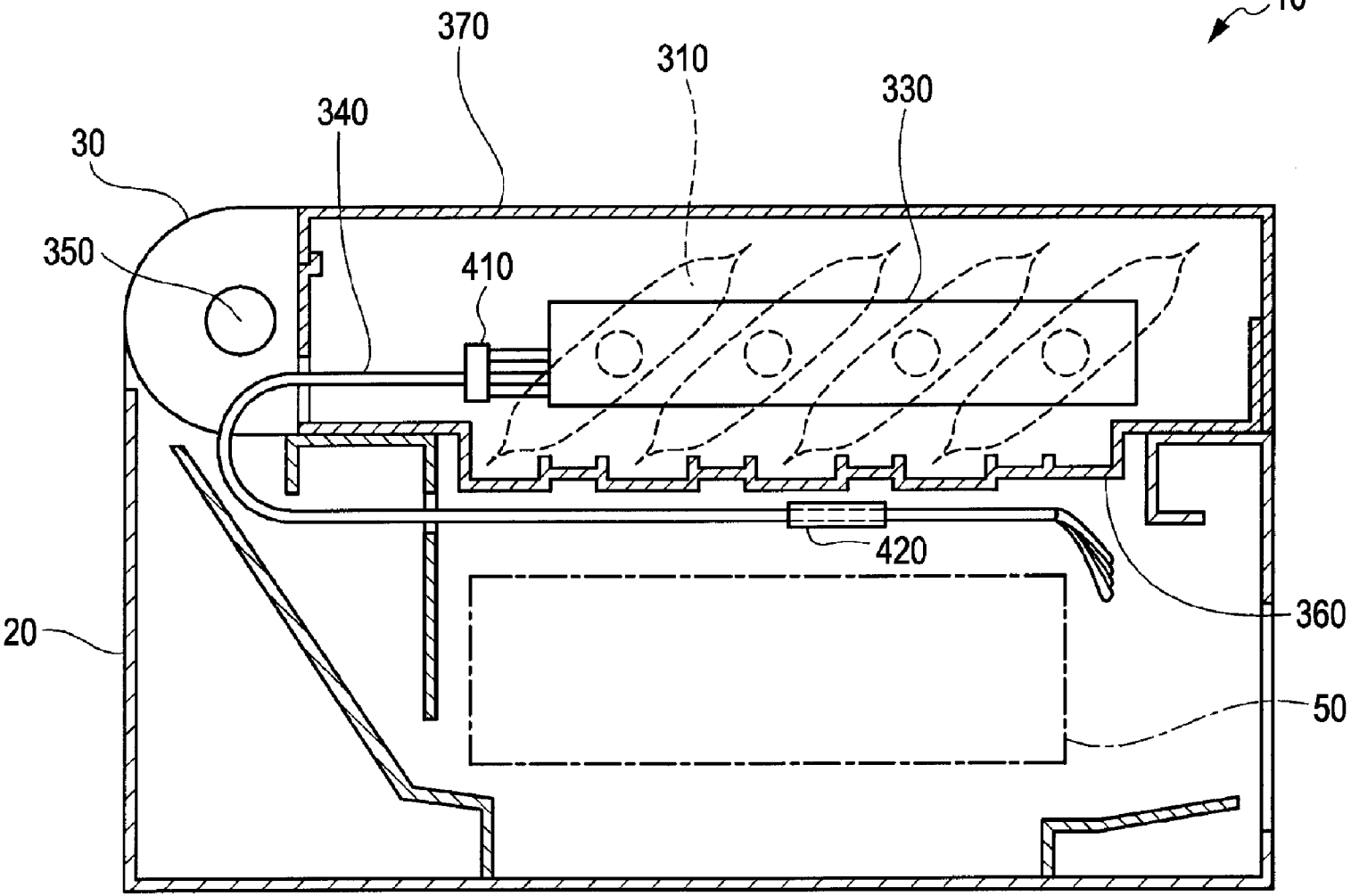
FIG. 5 is a cross-sectional view that illustrates the configuration of the printer with a closed upper housing.
Figure 6:
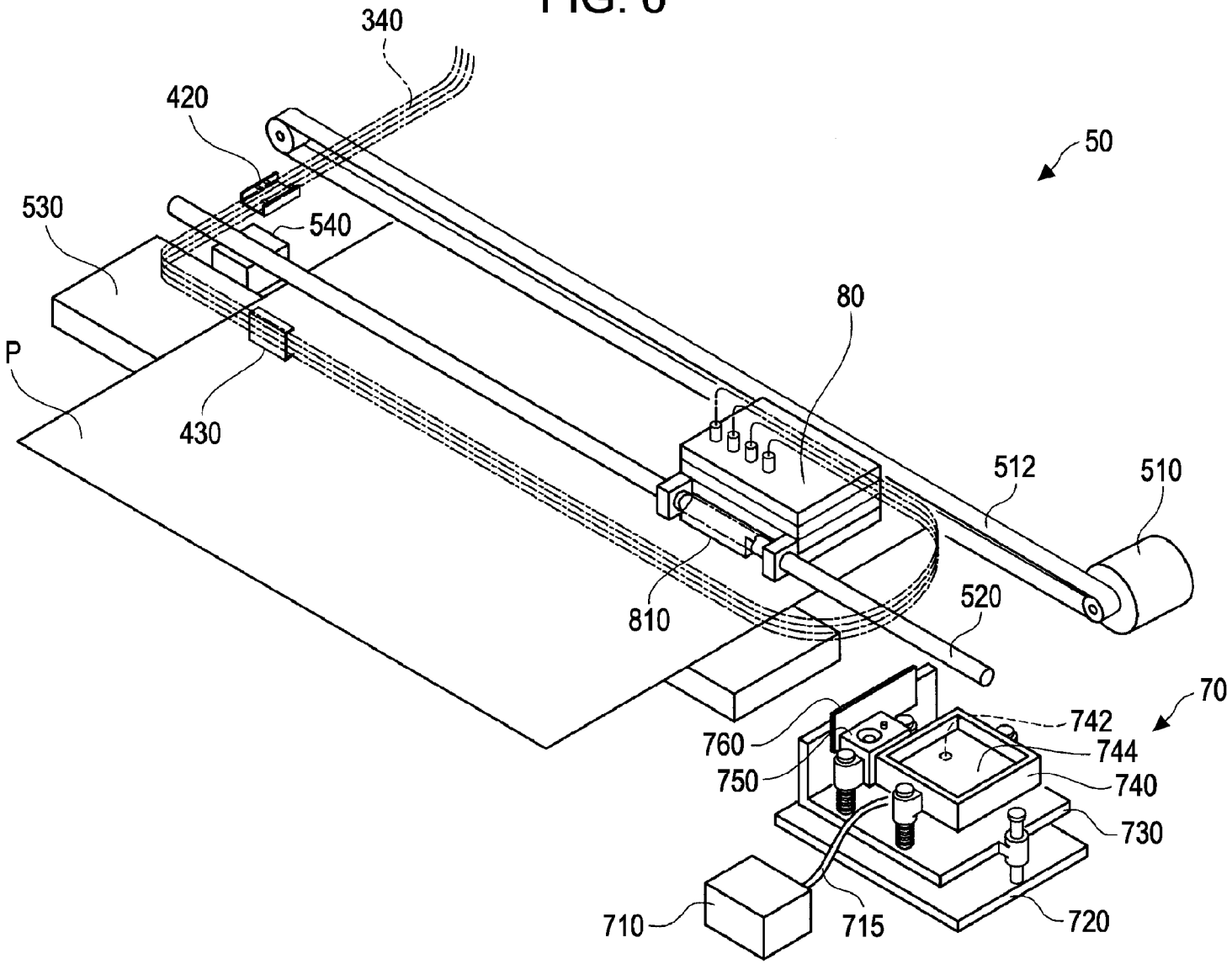
FIG. 6 is a perspective view that illustrates the configuration of the print mechanism portion of the printer.

FIG. 5 is a cross-sectional view that illustrates the configuration of the printer 10 when the upper housing 30 is closed. FIG. 5 is a cross-sectional view as viewed from the opposite side of the cross-sectional view shown in FIG. 2. FIG. 6 is a perspective view that illustrates the configuration of portions around the print mechanism portion 50 of the printer 10. As shown in FIG. 5 and FIG. 6, the supply tube 340 connects the ink supply portion 330 with the carriage 80 of the print mechanism portion 50 and supplies ink contained in the ink packs 310 to the carriage 80. The supply tube 340 is supported by support portions 420 and 430. The support portions 420 and 430 are fixed directly or indirectly to the main housing 20 of the printer 10. Therefore, the supply tube 340 is supported by the body of the printer 10 through the support portions 420 and 430.

As shown in FIG. 6, the print mechanism portion 50 includes a rectangular platen 530 that is arranged in a print area where ink droplets are ejected onto a print sheet P. The print sheet P is fed by a paper feed mechanism (not shown) onto the platen 530. The print mechanism portion 50 is connected to the supply tube 340 and includes the carriage 80 on which the recording head 810 is mounted. The carriage 80 forms part of the ink flow passage that extends from the ink packs 310 to the recording head 810. The carriage 80 is movably supported in the longitudinal direction of the platen 530 along a guide rod 520, and is driven by a carriage motor 510, which serves as a carriage driving portion, through a timing belt 512. In this manner, the carriage 80 is reciprocally moved above the platen 530 in the longitudinal direction. The recording head 810 receives ink supplied through the carriage 80 and discharges the ink onto the print sheet P.

Inside the main housing 20, a home position, where the carriage 80 is placed in a standby state, is provided in a non-print area that is located on one end of the printer 10 and outside the print area where the platen 530 is arranged. A maintenance mechanism portion 70 that maintains the carriage 80 is provided at the home position.

As shown in FIG. 6, the maintenance mechanism portion 70 includes a head cap 740, a detachable connecting portion 750, a wiper blade 760, and a vacuum pump 710. The head cap 740 covers the lower face of the recording head 810. The detachable connecting portion 750 is detachably connected to gas recovery chambers 821 and 841 of the carriage 80, describe more fully below. The wiper blade 760 wipes away ink adhered on the lower face of the recording head 810. The vacuum pump 710, which serves as a decompressing portion, supplies a negative pressure to the head cap 740 and the detachable connecting portion 750 through a vacuum tube 715. The head cap 740, the detachable connecting portion 750, and the wiper blade 760 are arranged on an elevating base 730. The elevating base 730 is elevatably supported on a base 720 that is fixed to the main housing 20.

Figure 7:
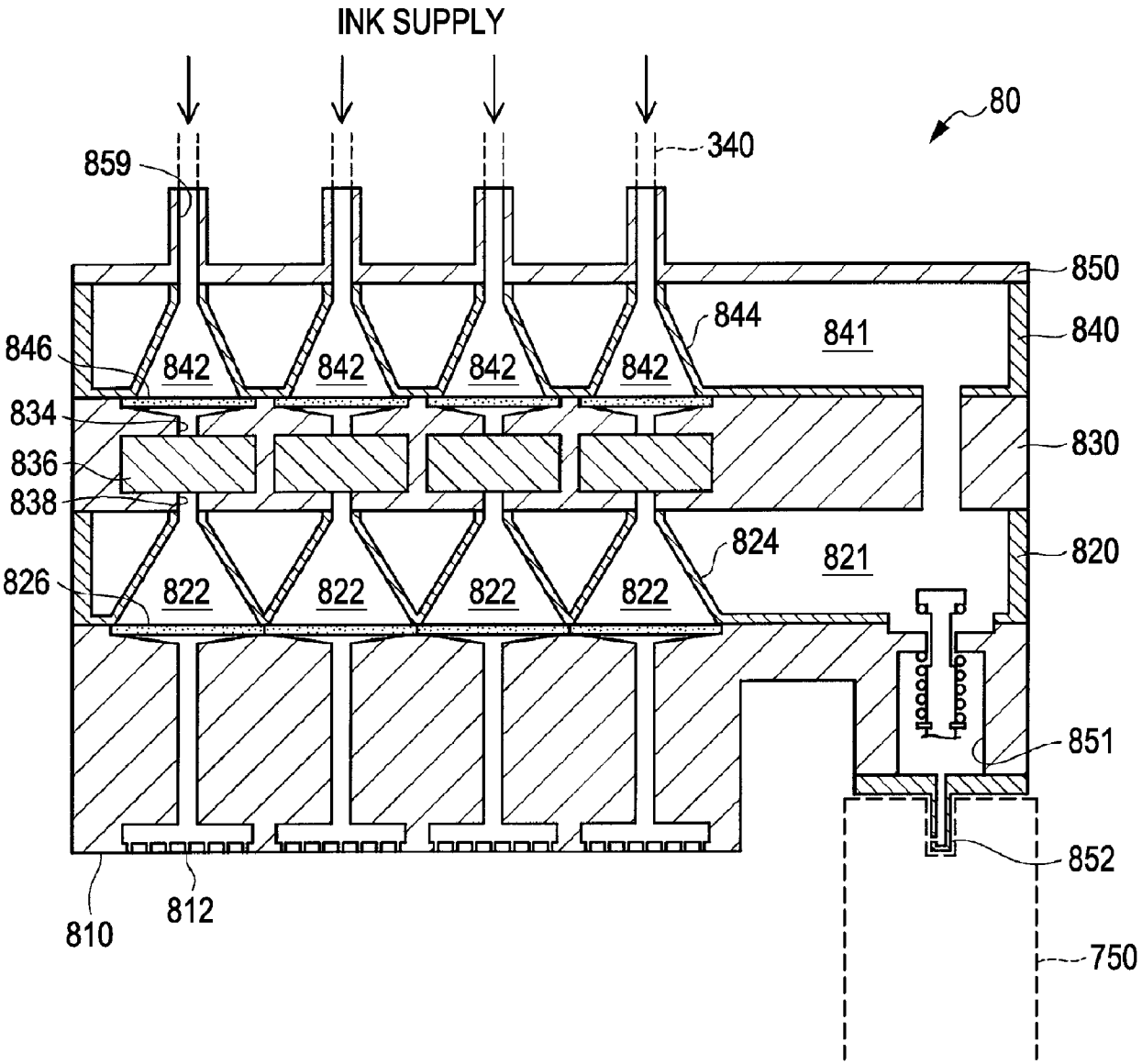
FIG. 7 is a view that illustrates the internal configuration of a carriage.

FIG. 7 is a view that illustrates the internal configuration of the carriage 80. The recording head 810 that discharges ink droplets from nozzles 812 by the expansion and contraction of piezoelectric vibrators (not shown) provided at the lower portion of the carriage 80. In the present embodiment, the recording head 810 is formed with four nozzle groups, each consisting of the plurality of nozzles 812, which correspond with four colors of ink. The recording head 810, which has the nozzles 812, may be regarded as a fluid discharging portion according to the aspects of the invention.

A second carriage member 820, a third carriage member 830, a fourth carriage member 840, and a fifth carriage member 850 are laminated on the recording head 810 in the stated order. The fifth carriage member 850 constitutes the upper face of the carriage 80. The fifth carriage member 850 has four ink introducing ports 859 that are connected to the supply tube 340 and that form part of the ink flow passage. The fourth carriage member 840 is laminated between the fifth carriage member 850 and the third carriage member 830. The fourth carriage member 840 has four upstream trap chambers 842 that are in fluid communication with the ink introducing ports 859 of the fifth carriage member 850. The third carriage member 830 is laminated between the fourth carriage member 840 and the second carriage member 820. The third carriage member 830 has four ink flow passages 834, four regulator valves 836 and four ink flow passages 838. The four ink flow passages 834 are in fluid communication with the upstream trap chambers 842 of the fourth carriage member 840 through filters 846. The four regulator valves 836 each adjust to reduce the pressure of ink flowing downstream to the recording head 810. The four ink flow passages 838 allow the ink from the regulator valves 836 to flow downstream to the recording head 810. The second carriage member 820 is laminated between the third carriage member 830 and the recording head 810. The second carriage member 820 has four downstream trap chambers 822 that are in fluid communication with the ink flow passages 838 of the third carriage member 830. The downstream trap chambers 822 are in fluid communication with the nozzles 812 through filters 826.

The carriage 80 is formed with the gas recovery chamber 841 and the gas recovery chamber 821. The gas recovery chamber 841 adjoins the upstream trap chambers 842 via a transmission wall 844. The gas recovery chamber 821 adjoins the downstream trap chambers 822 via a transmission wall 824. The gas recovery chamber 821 and the gas recovery chamber 841 are provided to remove bubbles that are included in ink inside the ink flow passage. That is, the carriage 80 has a hollow needle 852 that is connectable with the detachable connecting portion 750, shown in FIG. 6. As the hollow needle 852 of the carriage 80 is connected to the detachable connecting portion 750, the gas recovery chambers 821 and 841 are in fluid communication with the detachable connecting portion 750 through a decompression relay chamber 851. At this time, as the vacuum pump 710 performs vacuum operation, a negative pressure is applied to the gas recovery chambers 821 and 841. This removes bubbles that are included in ink inside the ink flow passage.

Figure 8:
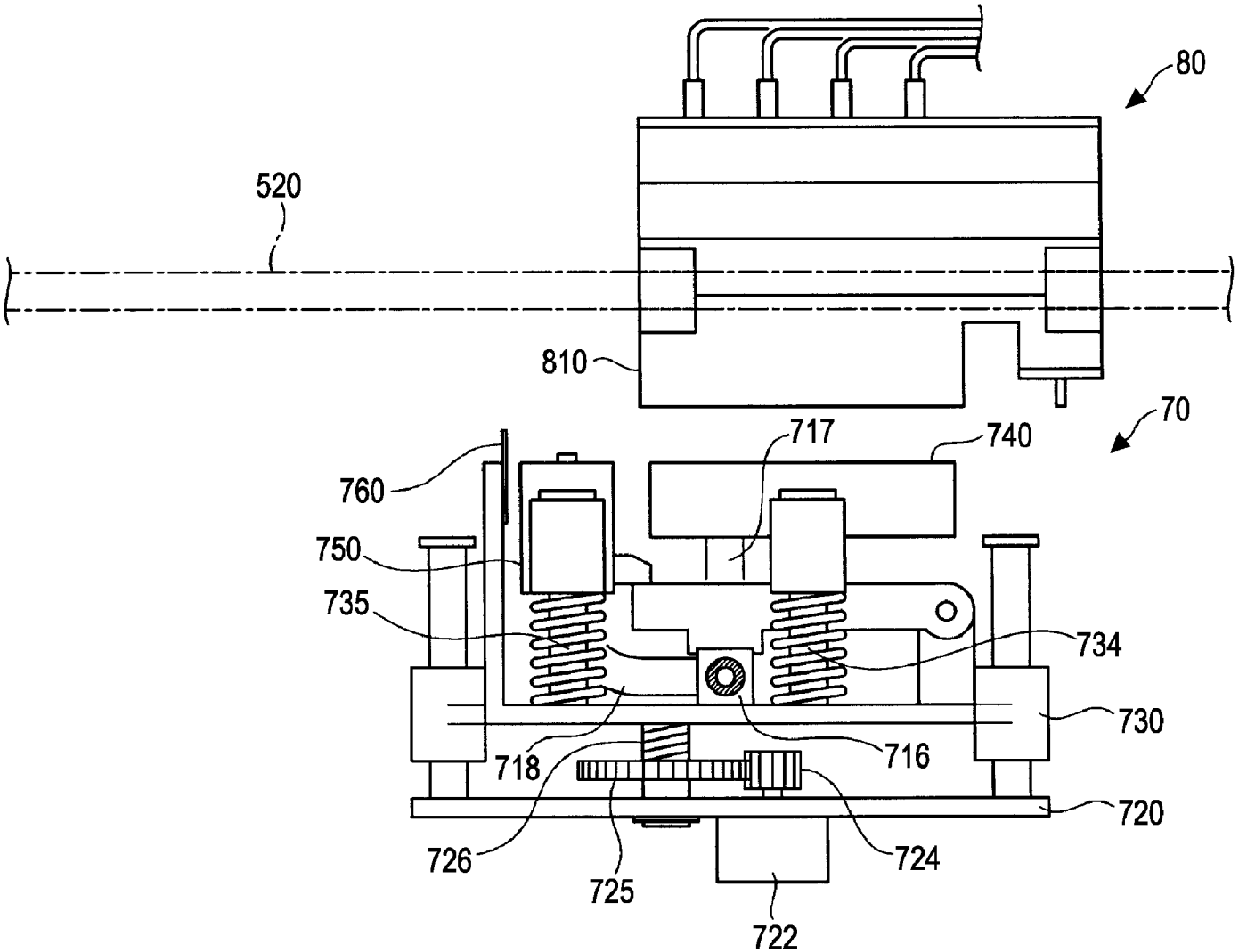
FIG. 8 is a view that illustrates a state wherein the carriage is moved to a position at which the carriage can be connected to a head cap.
Figure 9:
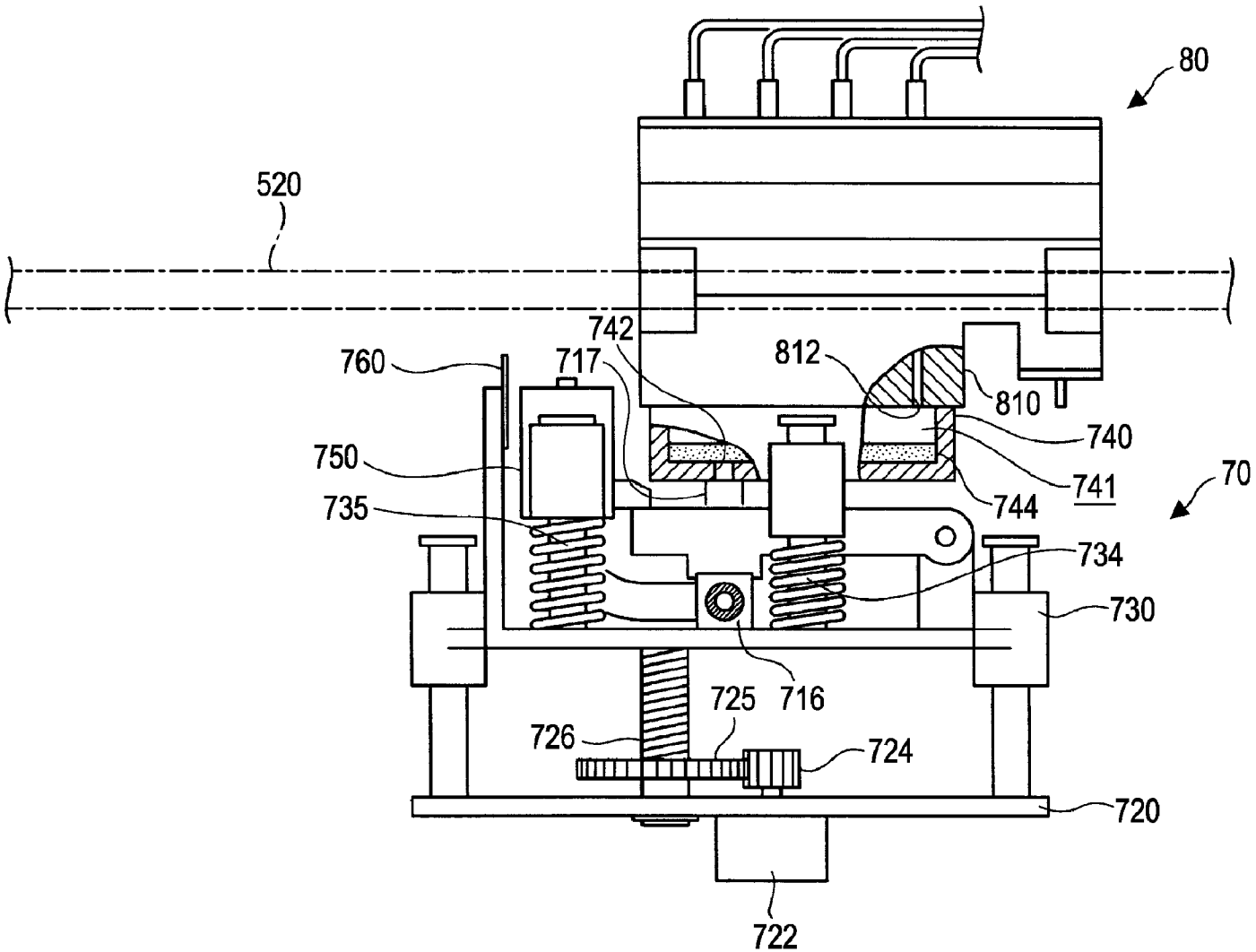
FIG. 9 is a view that illustrates a state in which the head cap is raised and connected to the carriage.

FIG. 8 is a view that illustrates a state in which the carriage 80 is moved to a position where the carriage 80 can be connected to the head cap 740. FIG. 9 is a view that illustrates a state in which the head cap 740 is raised and connected to the carriage 80. An urging support portion 734 and an urging support portion 735 are arranged on the elevating base 730 of the maintenance mechanism portion 70. The urging support portion 734 supports the head cap 740 while urging the head cap 740 upward. The urging support portion 735 supports the detachable connecting portion 750 while urging the detachable connecting portion 750 upward. An elevating motor 722 is arranged on the base 720 of the maintenance mechanism portion 70. As the elevating motor 722 rotates a lead screw 726 through transmission gears 724 and 725, the elevating base 730 that is screwed with the lead screw 726 moves up and down in accordance with the rotation of the lead screw 726.

The maintenance mechanism portion 70 is provided with a branch portion 716 that branches the vacuum tube 715 shown in FIG. 6 into the head cap 740 and the detachable connecting portion 750. A branch tube 717 is connected between the branch portion 716 and the head cap 740. A branch tube 718 is connected between the branch portion 716 and the detachable connecting portion 750. As shown in FIG. 9, the head cap 740, when it is raised to be connected to the carriage 80, forms an ink vacuum chamber 741 between the head cap 740 and the lower face of the recording head 810. The ink vacuum chamber 741 is in fluid communication with a connecting port 742 that is connected to the branch tube 717. In this state, as the vacuum pump 710 (shown in FIG. 6) performs vacuum operation, a negative pressure is applied to the ink vacuum chamber 741. Thus, the inside of the ink flow passage is vacuumed through the nozzles 812 of the recording head 810. Note that, a sponge 744 is arranged on the bottom face of the ink vacuum chamber 741 in order to absorb ink that is drained from the nozzles 812 to the ink vacuum chamber 741.

Figure 10:
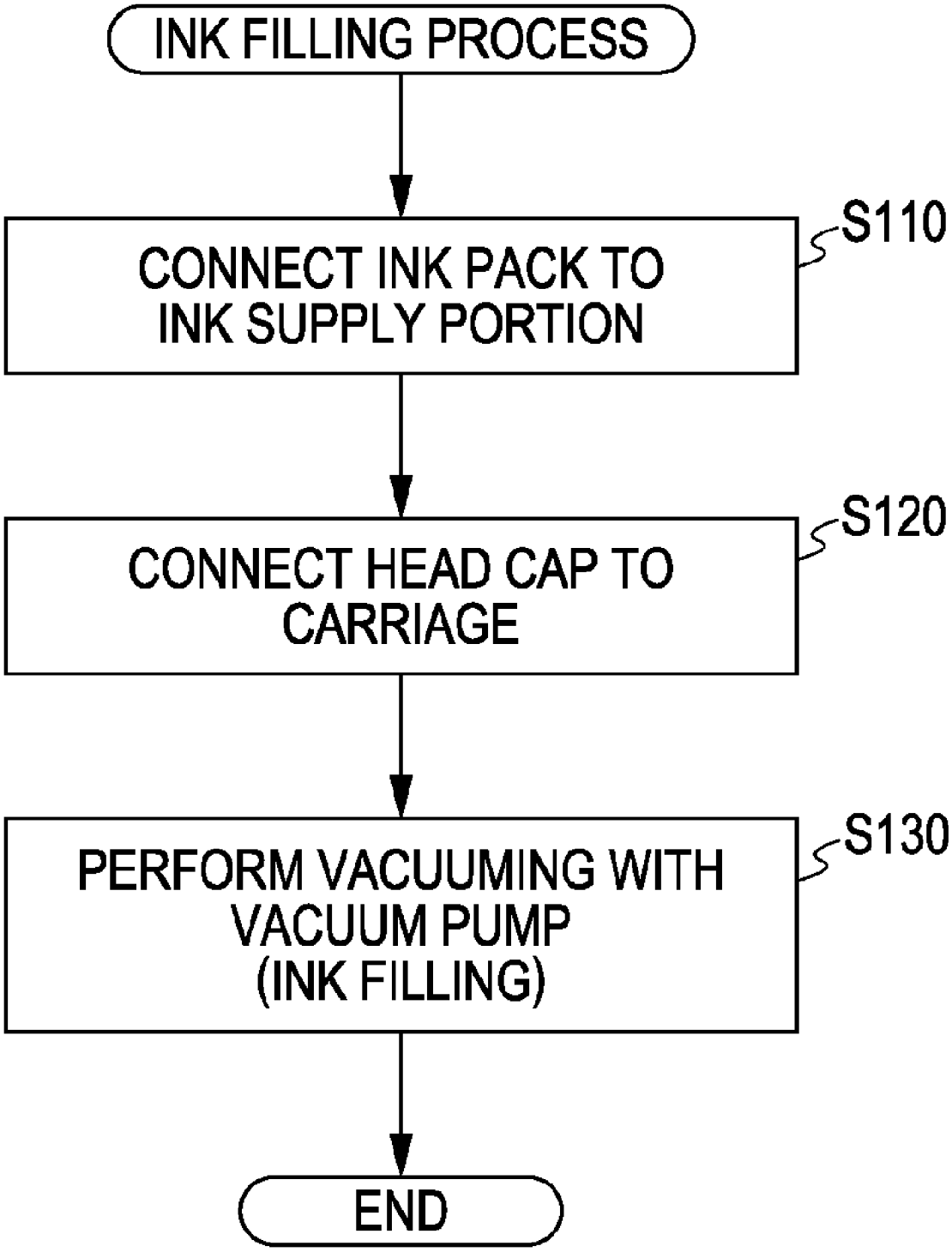
FIG. 10 is a flowchart that illustrates the flow of an ink filling process of the printer according to the first embodiment.

FIG. 10 is a flowchart that illustrates an ink filling process of the printer 10 according to the first embodiment. The ink filling process is, for example, performed at the last stage (shipping preparation stage) of the manufacturing process of the printer 10, that is, after printing check and cleaning of an ink supply system.

In step S110, the ink packs 310 that contain ink are connected to the ink supply portion 330 shown in FIG. 4. Note that, in step S110, the ink packs 310 that do not contain ink may be connected to the ink supply portion 330, and the ink packs 310 may be filled with ink.

In step S120, the head cap 740 of the maintenance mechanism portion 70 shown in FIG. 10 is connected to the carriage 80 shown in FIG. 9. In step S130, the vacuum pump 710 shown in FIG. 6 performs vacuum operation. As the vacuum pump 710 performs vacuum operation, a negative pressure is applied to the ink vacuum chamber 741 shown in FIG. 9, thus vacuuming the inside of the ink flow passage through the nozzles 812 of the recording head 810. As a result, ink flows out from the ink packs 310 to fill the ink flow passage. The amount that the ink flow passage is filled with ink varies in accordance with a period of time during which the vacuum pump 710 performs vacuum operation. The vacuum operation of the vacuum pump 710 may be performed so that ink fills the ink supply portion 330 connected to the ink packs 310 to the middle of the supply tube 340. The vacuum operation of the vacuum pump 710 may also be performed so that ink fills the recording head 810 of the carriage 80, that is, ink fills all the ink flow passages of the recording head.

Through the above described ink filling process, the printer 10 is placed in a state (hereinafter, referred to as "first initial state") where at least portion of the ink flow passage that extends from the ink packs 310 to the recording head 810 or portion of the recording head 810 itself is filled with ink. After that, the printer 10 is shipped for user use. That is, the printer 10 is placed in the first initial state before the initial use of the printer 10 after the ink packs 310 are filled with ink. Thus, it is not necessary to fill the printer 10 with a distribution-purpose ink or a preservative solution. In addition, before the printer 10 is used, it is possible to suppress entry of foreign matter, such as distribution-purpose ink, air, or the like, from entering the ink packs 310. This makes it possible to suppress a decrease in the quality of ink contained in the ink packs 310, due to deaeration or the like. Moreover, when the user initially uses the printer 10, the ink packs 310 are already installed in the printer 10. This eliminates attachment work of the ink packs 310 by the user, reducing the burden on the user. Furthermore, because the printer 10 remains in a state (first initial state) where the ink flow passage is filled with ink until the user starts using the printer 10, the ink flow passage is accustomed to being filled ink and, as a result, filling of ink into the ink flow passage after the user starts using is smoothly performed.

Note that the ink filling process shown in FIG. 10 may be performed at the time when one or plurality of ink packs 310, set in the printer 10, run out of ink after the user starts using the printer 10. In the ink filling process at this time, after removing the ink pack 310 that runs out of ink, connection of the ink packs 310 in step S110 is performed. Alternatively, filling the ink pack 310 that runs out of ink with ink may be performed. After that, steps S120 and S130 are performed. In this case as well, the printer 10 is placed in the first initial state before the initial use of the printer after the ink pack 310 that runs out of ink is filled with ink.

B. Second Embodiment

Figure 11:
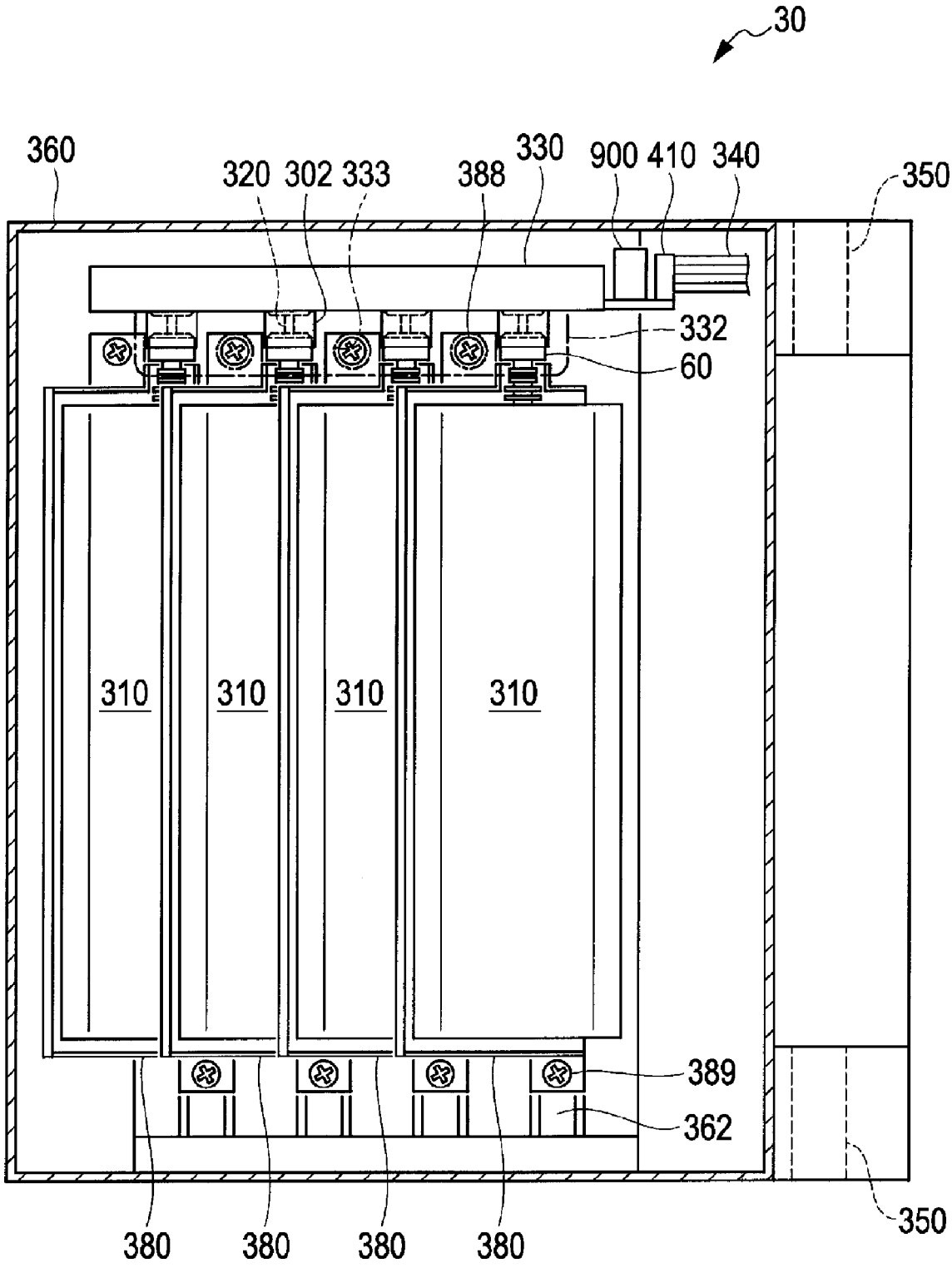
FIG. 11 is a top view that illustrates the internal configuration of an upper housing of a printer according to a second embodiment.

FIG. 11 is a top view that illustrates the internal configuration of the upper housing 30 of the printer 10 according to a second embodiment. The second embodiment differs from the first embodiment shown in FIG. 4 in that the printer 10 of the second embodiment includes a choke valve mechanism 900. The choke valve mechanism 900 is arranged near a position at which the ink supply portion 330 is connected to the supply tube 340. The choke valve mechanism 900, as described more fully below, is configured to open or close the ink flow passage that extends from the ink packs 310 to the recording head 810.

Figure 12:
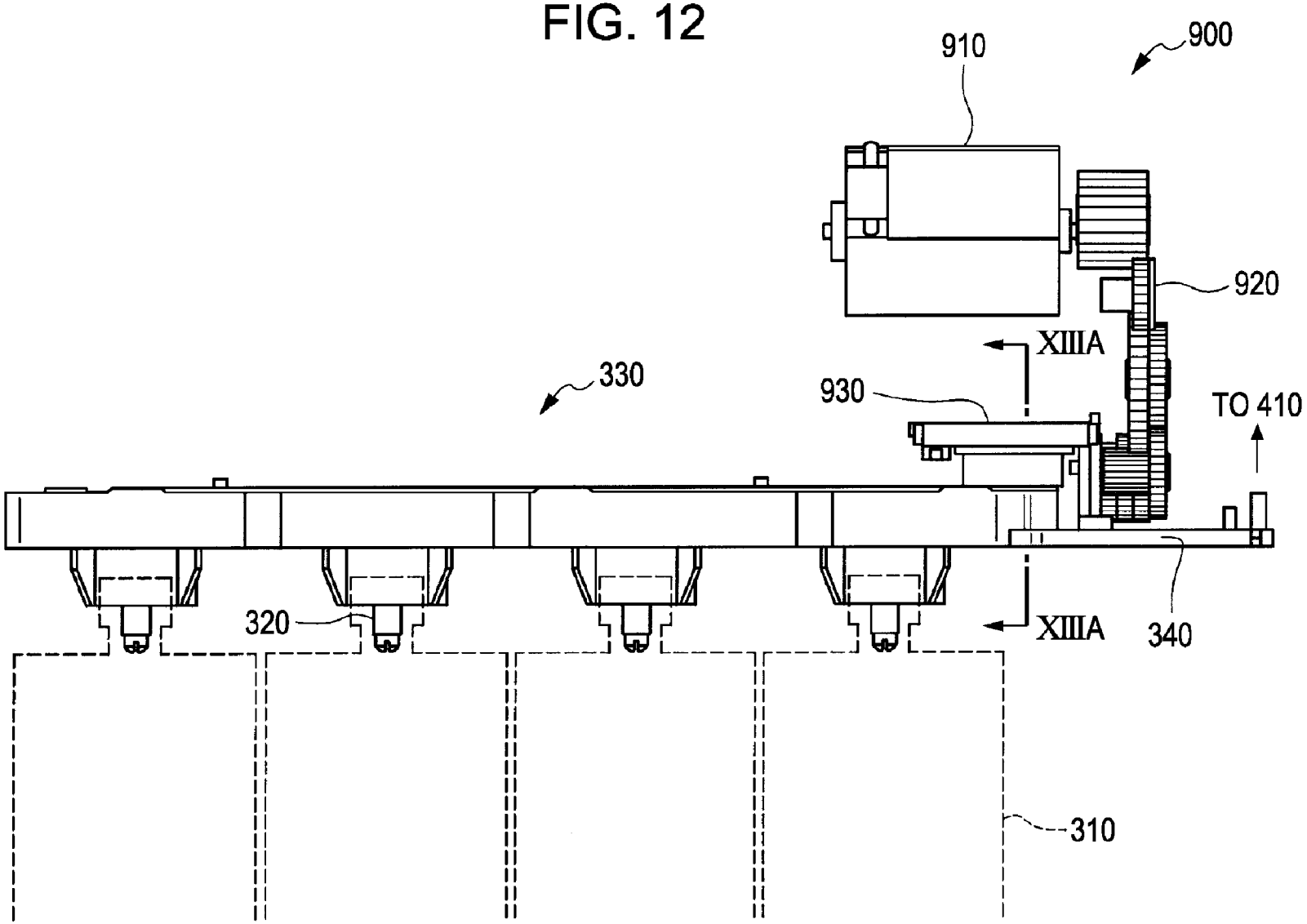
FIG. 12 is a view that illustrates the configuration of a choke valve mechanism.
Figure 13A:
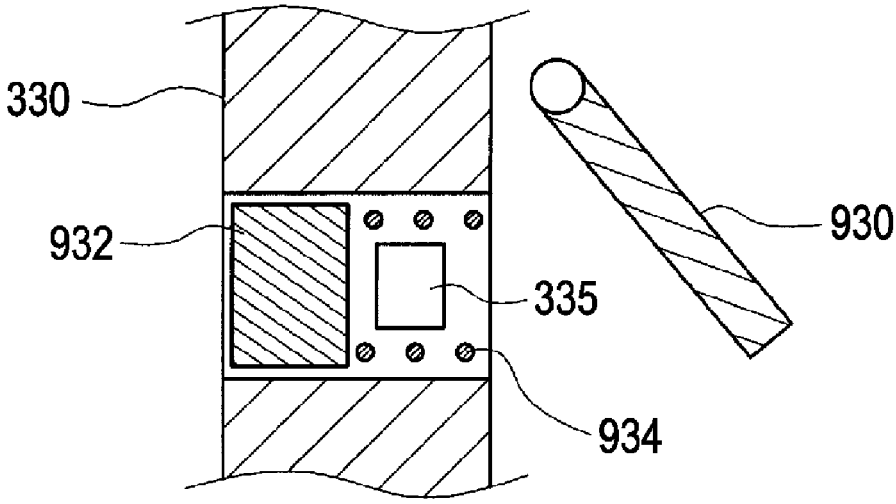
FIG. 13A and FIG. 13B are cross-sectional views that are taken along the line XIIIA-XIIIA in FIG. 12.
Figure 13B:
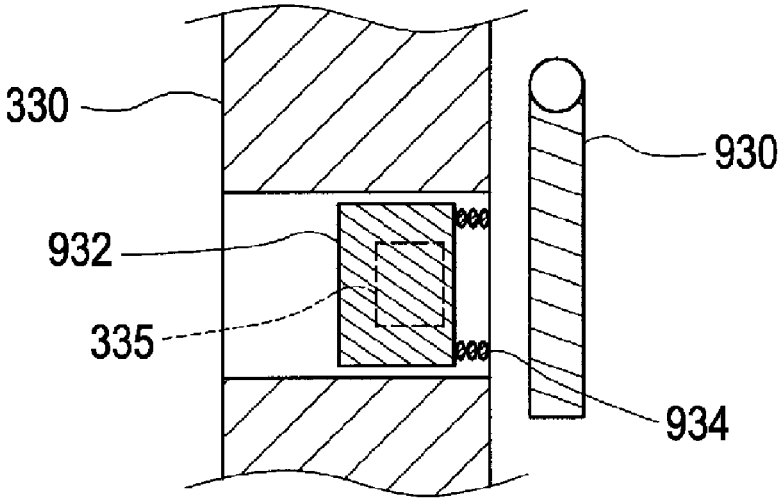

FIG. 12 illustrates the configuration of the choke valve mechanism 900. FIG. 13A and FIG. 13B are cross-sectional views that are taken along the line XIIIA-XIIIA in FIG. 12. As shown in FIG. 12, the choke valve mechanism 900 includes a choking DC motor 910, a gear train 920 and a magnet portion 930. The gear train 920 transmits the rotary torque of the choking DC motor 910. The magnet portion 930 approaches or moves away from the ink supply portion 330 by the rotary torque transmitted by the gear train 920. FIG. 13A illustrates a state (hereinafter, referred to as "farthest state") wherein the magnet portion 930 is located farthest from the ink supply portion 330. FIG. 13B illustrates a state (hereinafter, referred to as "nearest state") wherein the magnet portion 930 is located nearest to the ink supply portion 330. Note that the gear train 920 is configured to freely turn to interrupt the transmission of torque to the magnet portion 930 when the rotary torque tends to move the magnet portion 930 away from the ink supply portion 330 when the magnet portion 930 is already located the farthest away from the supply portion 330. This also applies when the rotary torque tends to move the magnet portion 930 toward the ink supply portion 330 when the magnet portion 930 is placed the nearest to the supply portion 330.

Furthermore, as shown in FIG. 13A and FIG. 13B, the choke valve mechanism 900 includes valve elements 932 that are set inside the ink supply portion 330. The valve elements 932 each are slidable so as to open or close a hollow flow passage 335, which is formed inside the ink supply portion 330, in order to form an ink flow passage. Each valve element 932 is urged by a spring 934 to a position at which the hollow flow passage 335 is open, as shown in FIG. 13A. In this embodiment, each valve element 932 is formed of metal, such as iron. As shown in FIG. 13B, as the magnet portion 930 approaches the ink supply portion 330, the valve element 932 is moved by a magnetic force in a direction so that the hollow flow passage 335 is closed. In this way, the choke valve mechanism 900 is able to change the size of the cross-sectional area of the hollow flow passage 335 where the ink flows in the ink supply portion 330 within a range from 100%, when the flow passage 335 is completely opened, to 0%, when the flow passage 335 is completely closed. Note that FIG. 13A and FIG. 13B show only one set of the hollow flow passage 335 and the valve element 932, which corresponds to one color of ink; however, the choke valve mechanism 900 has actually four sets of hollow flow passages 335 and valve elements 932, which correspond to each of the four colors of ink. The choke valve mechanism 900 is able to open or close the four hollow flow passages 335 by moving the magnet portion 930.

Figure 14:
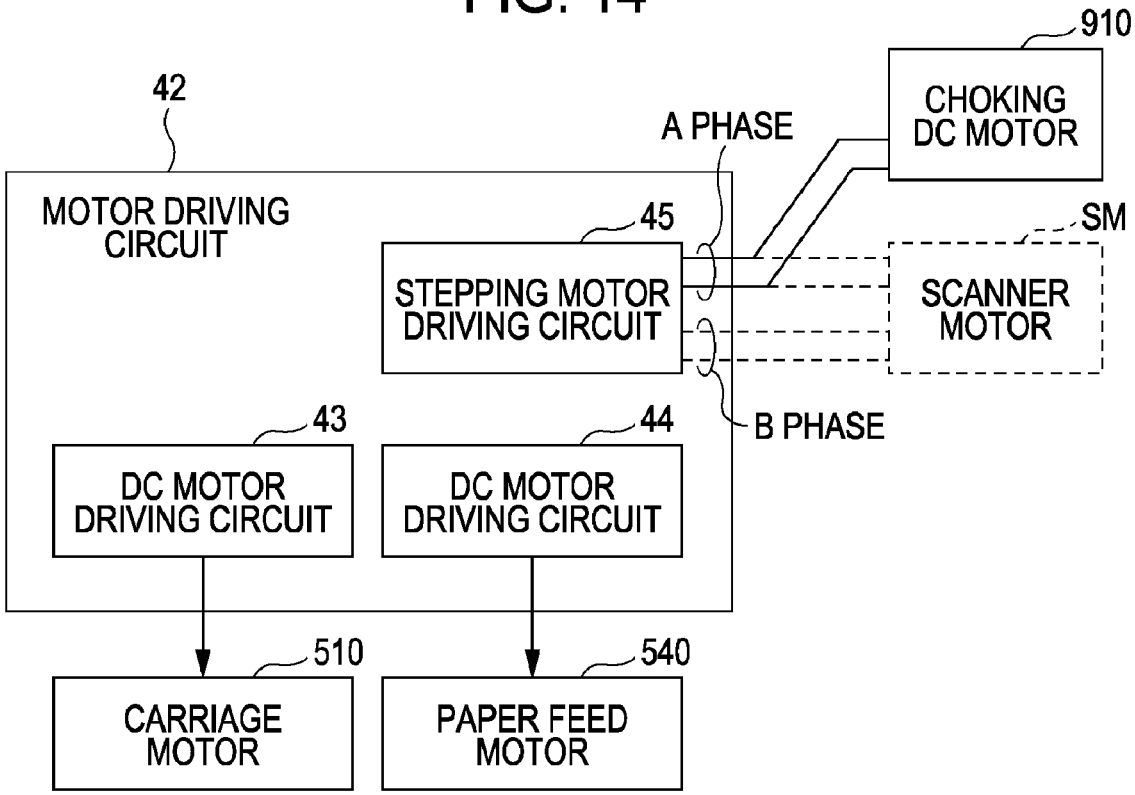
FIG. 14 is a block diagram that illustrates the configuration of a motor driving circuit included in a control portion.

FIG. 14 is a block diagram that illustrates the configuration of a motor driving circuit 42 included in the control portion 40 (see FIG. 1). The motor driving circuit 42 includes a DC motor driving circuit 43 for the carriage motor 510 that drives the carriage 80 and a DC motor driving circuit 44 for the paper feed motor 540 that performs a paper feeding process.

The motor driving circuit 42 of the present embodiment further includes a stepping motor driving circuit 45. The printer 10 of the present embodiment is configured to use the configuration of an existing on-carriage printer that includes a scanner mechanism at a portion corresponding to the upper housing 30. The motor driving circuit 42 includes the stepping motor driving circuit 45, which serves as a driving circuit for a scanner motor SM. The scanner motor SM is, for example, four-phase stepping motor. The stepping motor driving circuit 45, for example, performs driving of the scanner motor SM with W1-2 phase excitation.

Figure 15:
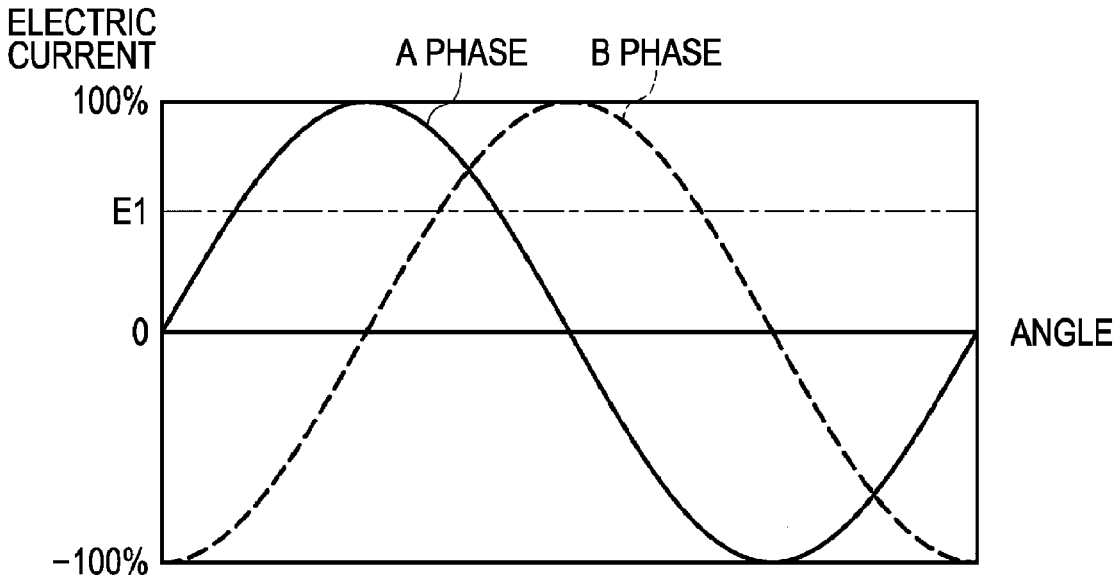
FIG. 15 is a graph that illustrates an example of a microstep driving signal for a stepping motor driving circuit.

In the present embodiment, the choking DC motor 910 is driven by the stepping motor driving circuit 45. The choking DC motor 910 is connected to the A-phase terminal of the stepping motor driving circuit 45. The choking DC motor 910 is driven using a microstep driving signal for the stepping motor driving circuit 45. FIG. 15 is a graph that illustrates an example of a microstep driving signal for the stepping motor driving circuit 45. As shown in FIG. 15, the stepping motor driving circuit 45 is able to minutely set the angle for the scanner motor SM using a combination of an A-phase electric current value and a B-phase electric current value. In the present embodiment, for example, an A-phase electric current value E1 is applied to the choking DC motor 910 to drive the choking DC motor 910.

Figure 16A:
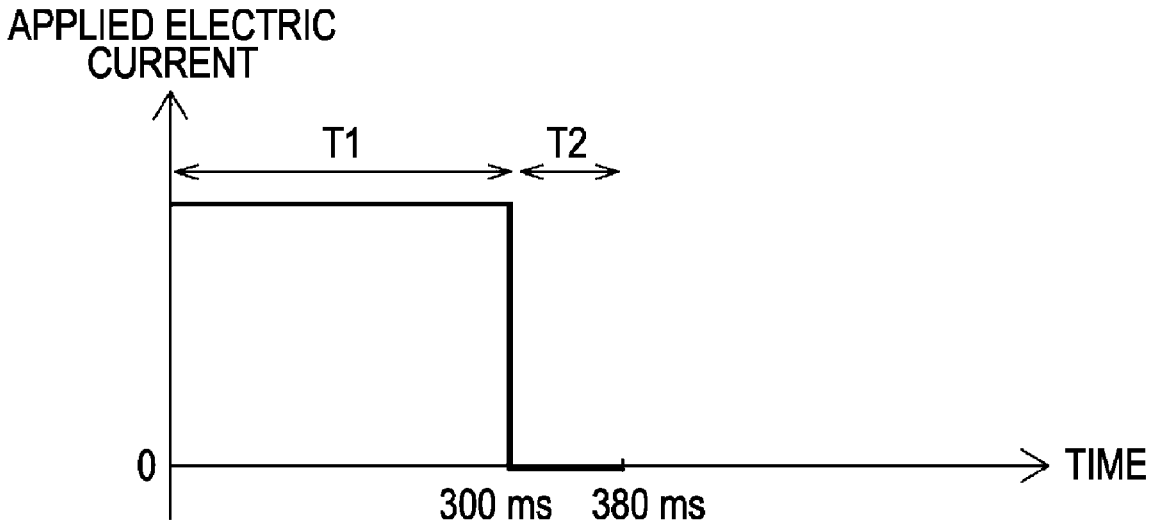
FIG. 16A and FIG. 16B are graphs that show driving timings for a choking DC motor.
Figure 16B:
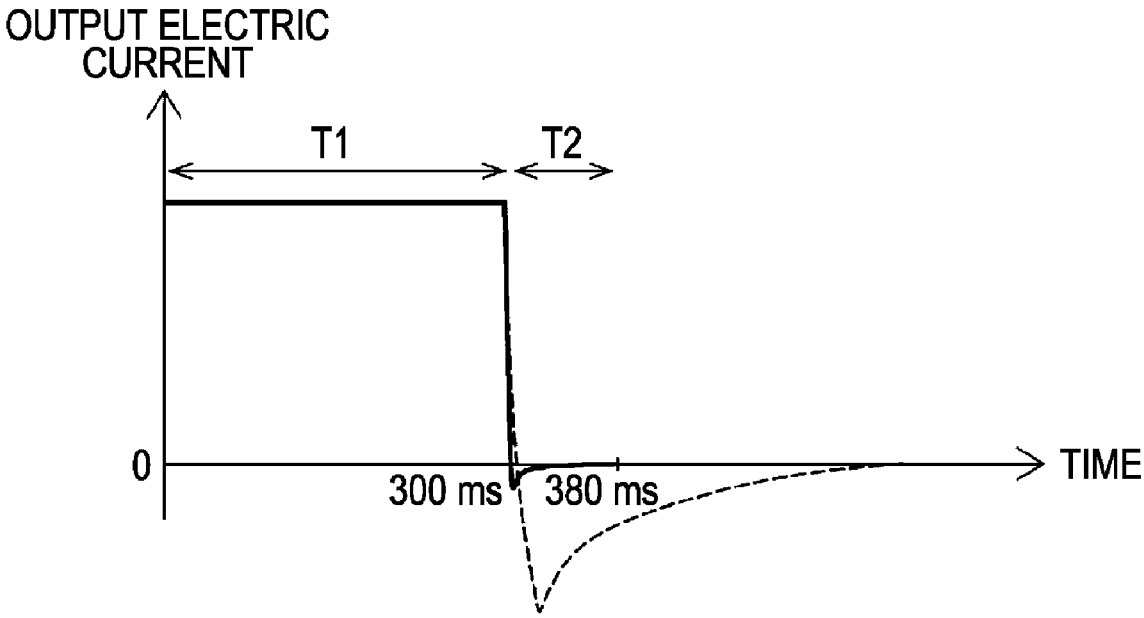

FIG. 16A and FIG. 16B are graphs that show driving timings of the choking DC motor 910. FIG. 16A illustrates an electric current applied to the choking DC motor 910 at the time of operation when the magnet portion 930 (see FIG. 13) is moved from the state farthest from the supply portion 330 to the state nearest to the supply portion 330 in order to close the hollow flow passages 335. FIG. 16B illustrates an output electric current of the choking DC motor 910 at the same time. As shown in FIG. 16A, during a period of time (referred to as "period T1") when 300 ms elapses from the start of the operation, the stepping motor driving circuit 45 applies a constant electric current to the choking DC motor 910. At this time, the rotary torque of the choking DC motor 910 is transmitted through the gear train 920 to the magnet portion 930, and the magnet portion 930 approaches the ink supply portion 330 until it is placed in the state nearest to the supply portion 330.

During a period of time (referred to as "period T2") when 80 ms elapses from the end of the period T1, the stepping motor driving circuit 45 applies an electric current to the choking DC motor 910, which is the reverse direction from the applied electric current that was applied during the period T1. Note that the magnitude of electric current at this time is preferably as close to 0 as possible. An electric current during the period T2 is applied in a direction reverse to that of the electric current applied during the period T1 in order to quickly stop the choking DC motor 910. In some instances, although an electric current is not applied to the choking DC motor 910 during the period T2, as is indicated by the broken line in FIG. 16B, the choking DC motor 910 may still rotate after the electric current is stopped due to inertia. In such instances, the choking DC motor 910 may stop rotation after, for example, about one second has elapsed from the start of operation. At this time, annoying noise may possibly occur. On the other hand, when an electric current is applied during the period T2 in the reverse direction to the electric current applied during the period T1, as indicated by the solid line in FIG. 16B, a braking action is applied to the rotation of the motor which stops the rotation of the motor in a relatively short period of time, and the annoying noise is suppressed.

Note that the applied electric current and the output electric current of the choking DC motor 910 at the time when the magnet portion 930 is moved from the nearest state to the farthest state to open the hollow flow passages 335 are reverse electric currents from the direction of the electric current and the output electric current applied when the hollow flow passages 335 are closed as shown in FIG. 16A and FIG. 16B. In addition, the duration of the period T1 is determined in advance as driving time that is sufficient for the choking DC motor 910 to move the magnet portion 930 from the farthest state to the nearest state (and vice versa). In this example, T1 is 300 ms. In addition, the duration of the period T2 is determined in advance as the amount of time that is sufficient for the choking DC motor 910 to stop rotating after the electric current of period T1 is stopped. In this example, T2 is 80 ms.

In this way, the choking DC motor 910 is driven by the stepping motor driving circuit 45. Thus, an existing circuit may be effectively used and, as a result, a new circuit component is not necessary. In addition, an existing design may be utilized and, hence, the work for designing a new design may be reduced. Furthermore, a motor that does not require highly accurate rotation control, such as the choking DC motor 910, may be controlled without feedback control.

Figure 17:
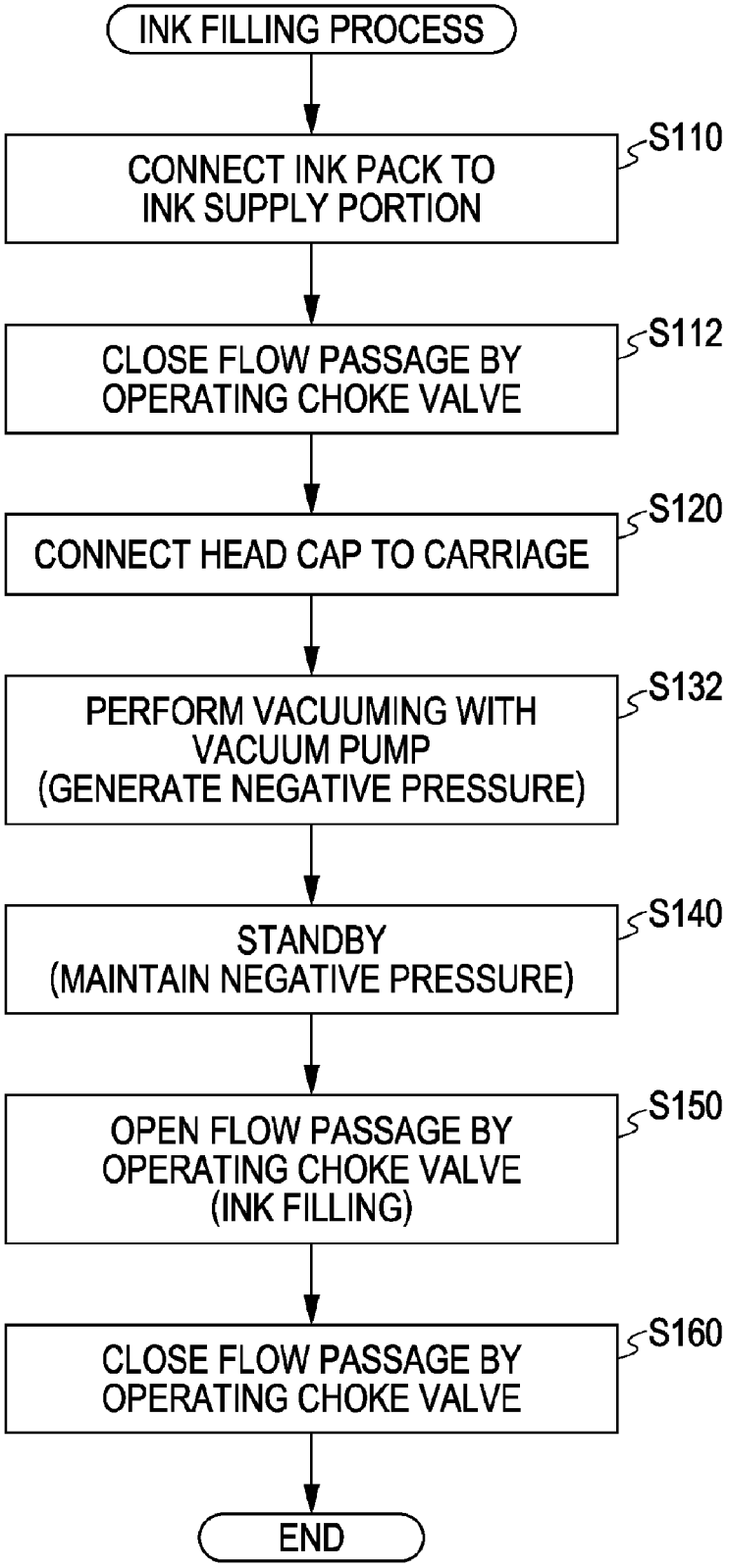
FIG. 17 is a flowchart that illustrates an ink filling process of the printer according to the second embodiment.

FIG. 17 is a flowchart that illustrates an ink filling process of the printer 10 according to the second embodiment. The ink filling process of the second embodiment, as well as the ink filling process of the first embodiment shown in FIG. 10, is, for example, performed at the last shipping preparation stage of the manufacturing process of the printer 10, that is, after the printing check and cleaning of an ink supply system have been performed. In step S110, the ink packs 310 that contain ink are connected to the ink supply portion 330, as in the first embodiment.

In step S112 the hollow flow passages 335 are closed by operating the choke valve mechanism 900. In step S120, the head cap 740 of the maintenance mechanism portion 70 is connected to the carriage 80. In step S132, the vacuum pump 710 performs a vacuuming operation. As the vacuum pump 710 performs the vacuuming operation, a negative pressure is applied to the ink vacuum chamber 741, thus vacuuming the inside of the ink flow passage through the nozzles 812 of the recording head 810. At this time, because the hollow flow passages 335 of the ink supply portion 330 are closed by the choke valve mechanism 900, a negative pressure is generated in portion of the ink flow passage on the side of the recording head 810. In the meantime, cleaning fluid that remains in the ink flow passage is drained. On the other hand, a negative pressure is not applied to portion of the ink flow passage on the side of choke valve mechanism 900 where the ink packs 310 are located, so that ink continuously remains in the ink packs 310. In step S140, the printer 10 is placed on standby for a predetermined period of time in order to maintain the negative pressure generated in the portion of ink flow passage on the side of the choke valve mechanism 900 where the recording head 810 is located.

In step S150, the hollow flow passages 335 (shown in FIG. 13A and FIG. 13B) are opened by operating the choke valve mechanism 900. Thus, the negative pressure is supplied to the portion of the ink flow passage through the choke valve mechanism 900 to allow the ink to flow out of the ink packs 310 and, as a result, fill the ink flow passage with the ink. After the ink flow passage is filled with the ink to the location where the choke valve mechanism 900 is located. Then, the hollow flow passages 335 are closed by operating the choke valve mechanism 900 (step S160). Note that the operation by which the choke valve mechanism 900 closes the hollow flow passage 335 is performed before ink fills the ink flow passage to the recording head 810 of the carriage 80.

Through the above described ink filling process according to the second embodiment, the printer 10 is placed in a state (hereinafter, referred to as "second initial state") where at least a portion of ink flow passage is filled, from the position facing the ink packs 310 to the position where the choke valve mechanism 900 is located. After that, the printer 10 is shipped and the user starts using it. That is, the printer 10 is placed in the second initial state before the initial use of the printer 10 after the ink packs 310 have been filled with ink. Thus, filling material that will be unnecessary after the use of the printer 10, such as distribution-purpose ink or a preservative solution, is not required. In addition, before the use of the printer 10, it is possible to suppress entry of foreign matter, such as distribution-purpose ink, air, or the like, into the ink packs 310. This makes it possible to suppress a decrease in the quality of ink contained in the ink packs 310. This is particularly true when the printer is shipped in the second initial state, because the hollow flow passages 335 are closed by the choke valve mechanism 900, with the ink filling the portion of ink flow passage from the position facing the ink packs 310 to the position of the choke valve mechanism 900.

Moreover, when the user initially uses the printer 10, the ink packs 310 are already installed in the printer 10. This eliminates attachment work of the ink packs 310 by the user, and reduces the burden on the user. Furthermore, because the printer 10 remains in a state where the ink flow passage is filled with ink until the user starts using the printer 10, the ink flow passage is acclimated to ink and, as a result, the filling of ink into the ink flow passage after the user starts using may be smoothly performed.

In addition, in the ink filling process according to the second embodiment, the nozzles of the recording head 810 are not filled with ink before the initial use of the printer 10. This can suppress the occurrence of clogged nozzles 812 due to the ambient environment between the time that the printer 10 is shipped until the initial use of the printer 10, and also can suppress the occurrence of ink leakage from the nozzles, and the like.

In addition, in the ink filling process according to the second embodiment, a negative pressure is generated equally at portions of the four ink flow passages, which respectively correspond to four colors of ink, on the side of the recording head 810 with respect to the choke valve mechanism 900 through vacuum operation by the vacuum pump 710 (step S132 of FIG. 17). After that, the hollow flow passages 335 corresponding to the four ink flow passages are opened (step S150 of FIG. 17) by operating the choke valve mechanism 900 in order fill the four ink flow passages with ink. This suppresses irregularities wherein the ink flow passages corresponding to four colors of ink are non-uniformly filled with ink, which makes it possible to achieve favorable ink filling process.

Furthermore, in the ink filling process according to the second embodiment, after the hollow flow passages 335 are closed (step S112 of FIG. 17) by operating the choke valve mechanism 900, a vacuuming operation is performed by the vacuum pump 710 (step S132 of FIG. 17). This makes it possible to check for malfunctions in the choke valve mechanism 900, such as leaks, or the like. In addition, because remaining cleaning fluid in the ink flow passage may be drained, it is possible to suppress the occurrences of poor vacuuming and filling operations due to any residual cleaning fluid.

Note that the ink filling process (see FIG. 17) of the second embodiment may also be performed when one or plurality of ink packs 310 run out of ink after the user starts using the printer 10. In the ink filling process at this time, after removing the empty ink pack 310 and cleaning the ink supply system, new ink packs 310 are connected in step S110. Alternatively, the empty ink pack 310 may be refilled. Then, step S112 and the following steps are performed. In this case as well, after the ink packs 310 have been reconnected, the printer 10 is returned to the state where at least the portion of ink flow passage from the position facing the ink packs 310 to the position of the choke valve mechanism 900 is filled with ink and the hollow flow passages 335 are closed by the choke valve mechanism 900.

C. Third Embodiment

Figure 18:
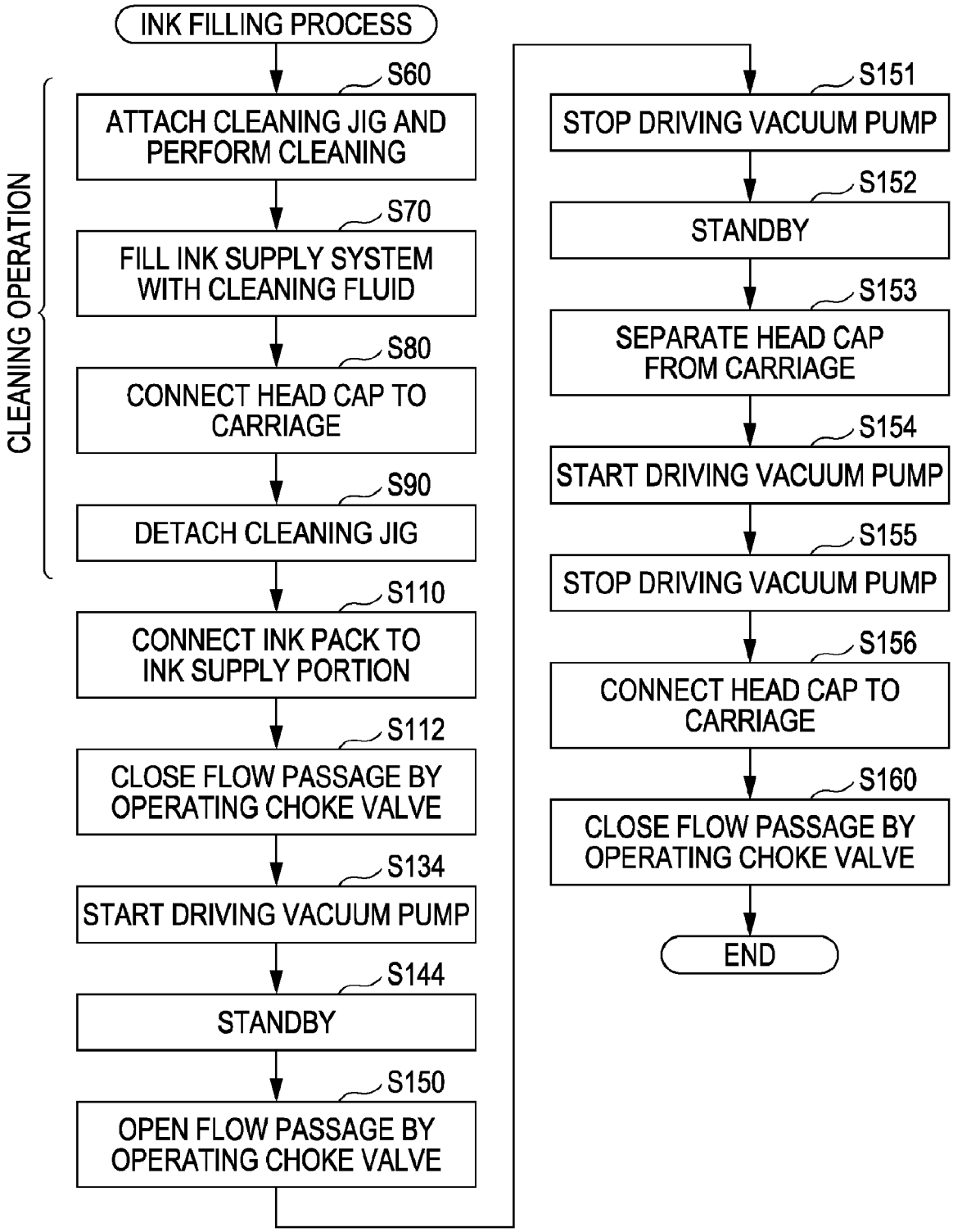
FIG. 18 is a flowchart that illustrates an ink filling process of a printer according to a third embodiment.

FIG. 18 is a flowchart that illustrates an ink filling process of the printer 10 according to a third embodiment. The ink filling process of the third embodiment, as well as the ink filling process of the second embodiment (see FIG. 17), is, for example, performed at the last shipping preparation stage of the manufacturing process of the printer 10. However, the flowchart shown in FIG. 18 differs from the flowchart shown in FIG. 17 in that a cleaning process for the ink supply system (steps S60 to S90) is also included.

As shown in FIG. 18, at step S60, a cleaning jig is attached to the printer 10 and then the ink supply system is cleaned. In step S70, cleaning fluid is supplied to fill the ink supply system. In the present embodiment, a distribution-purpose ink is used as the cleaning fluid. The distribution-purpose ink used in the present embodiment contains water, as a base, humectant, and surfactant but does not contain a color material (dye or pigment), which is a solid content. The distribution-purpose ink may be regarded as pre-use liquid according to the aspects of the invention. In step S80, the head cap 740 of the maintenance mechanism portion 70 is connected to the carriage 80. In step S90, the cleaning jig is removed.

After the cleaning process of the ink supply system is performed in steps S60 to S90, as in the case of the ink filling process of the second embodiment, the ink packs 310 that contain ink are connected to the ink supply portion 330 (step S110). Then, the hollow flow passages 335 are closed by operating the choke valve mechanism 900 (step S112), and a vacuuming operation is initiated (step S134) by starting driving of the vacuum pump 710. As the vacuum pump 710 performs vacuuming operation, a negative pressure is applied to the ink vacuum chamber 741, thus vacuuming the inside of the ink flow passage through the nozzles 812 of the recording head 810. At this time, a negative pressure is applied to the ink supply system on the recording head 810 side of the ink supply system. However, because the hollow flow passages 335 of the ink supply portion 330 are closed by the choke valve mechanism 900, the negative pressure is not applied to the portion of the ink flow passage on the ink packs 310 side of the choke valve mechanism 900. The printer 10 is then placed on standby in this state for a predetermined period of time (step S144).

At step S150, the hollow flow passages 335 are opened by operating the choke valve mechanism 900. Thus, the ink flow passage establishes communication from the carriage 80 to the supply needles 320. Then, a vacuuming operation drains cleaning fluid that fills the ink supply system into the head cap 740, and ink flows from the ink packs 310 into the ink flow passage. After the ink fills the ink flow passage up to the position of the choke valve mechanism 900, driving of the vacuum pump 710 is stopped (step S151) and then the printer 10 is maintained in this state for a predetermined standby period of time (step S152). By so doing, at least the portion of ink flow passage from the position facing the ink packs 310 to the position of the choke valve mechanism 900 is filled with ink, whereas the remaining portion of the ink flow passage and the recording head 810 are filled with cleaning fluid. In this state, the intersection between the ink supplied from the ink packs 310 and the cleaning fluid supplied to fill the ink flow passage in the cleaning process is located at the choke valve mechanism 900.

Then, the head cap 740 of the maintenance mechanism portion 70 is separated from the carriage 80 (step S153). Then, the vacuum pump 710 is started again (step S154). Thus, cleaning fluid accumulated in the head cap 740 is drained. The vacuum operation by the vacuum pump 710 at this time is also referred to as idle vacuum operation. After the cleaning fluid in the head cap 740 has been drained, driving of the vacuum pump 710 is stopped (step S155). After that, the head cap 740 of the maintenance mechanism portion 70 is connected to the carriage 80 again (step S156), and the hollow flow passages 335 are closed by operating the choke valve mechanism 900 (step S160). Note that the operation by which the choke valve mechanism 900 closes the hollow flow passages 335 may be performed after the standby step in step S152.

In the above described ink filling process according to the third embodiment, the printer 10 is placed in a state (hereinafter, referred to as "third initial state") where at least the portion of ink flow passage from the position facing the ink packs 310 to the position of the choke valve mechanism 900 is filled with ink supplied from the ink packs 310, and the remaining portion of the ink flow passage, including the recording head 810, is filled with cleaning fluid (distribution-purpose ink). During this time, the hollow flow passages 335 are closed by the choke valve mechanism 900. After that, the printer 10 is shipped and the user starts using it. That is, the printer 10 is placed in the third initial state before the initial use of the printer 10. Thus, before the printer 10 is used, it is possible to suppress entry of foreign matter, such as cleaning fluid, air, or the like, into the ink packs 310. This makes it possible to suppress a decrease in the quality of ink contained in the ink packs 310 and the occurrence of mixture of ink in the ink packs 310 and the cleaning fluid. That is, in the second initial state, because the hollow flow passages 335 are closed by the choke valve mechanism 900, ink that fills the portion of ink flow passage from the ink packs 310 to the choke valve mechanism 900 may be maintained after shipment. This reliably suppress entry of foreign matter into the ink packs 310.

Moreover, when the user initially uses the printer 10, the ink packs 310 have already been installed in the printer 10. This eliminates attachment work of the ink packs 310 and reduces the burden on the user. Furthermore, because the printer 10 remains in a state (third initial state) where the ink flow passage is filled with ink (both ink supplied from the ink packs 310 and distribution-purpose ink) until the user starts using the printer 10, the surface of a material that forms the ink flow passage is adapted to ink and, as a result, filling of ink into the ink flow passage after the user starts the printing process is more easily performed.

In addition, in the third initial state, because the portion of ink flow passage, other than the portion filled with ink supplied from the ink packs 310, and the recording head 810 are filled with cleaning fluid (distribution-purpose ink after shipment, even when the printer is subject to a high-temperature environment, it is possible to suppress an increase in internal pressure in the ink supply system or the recording head 810 to thereby make it possible to suppress ink leakage at coupling portions, or the like. Moreover, because the cleaning fluid (distribution-purpose ink) does not contain a color material (dye or pigment) which is a solid content, even when the printer 10 is subject to a high-temperature environment, clogged nozzles 812 do not occur.

In addition, in the ink filling process according to the third embodiment, a negative pressure is generated equally at portions of the four ink flow passages, which respectively correspond to four colors of ink through vacuum operation by the vacuum pump 710. After that, the hollow flow passages 335 corresponding to the four ink flow passages are opened by operating the choke valve mechanism 900 in order to fill the four ink flow passages with ink. This suppresses occurrences where the ink flow passages are non-uniformly filled, making it possible to achieve a more favorable ink filling process.

Furthermore, in the ink filling process according to the third embodiment, after the hollow flow passages 335 are closed by operating the choke valve mechanism 900, a vacuuming operation is performed by the vacuum pump 710. This makes it possible to check for any malfunctions in the choke valve mechanism 900.

Note that the ink filling process of the third embodiment, as well as the ink filling process of the first and second embodiments, the ink filling process may be performed when one or plurality of ink packs 310 run out of ink after the user starts using the printer 10. During this process, after removing the empty ink pack 310 and cleaning the ink supply system (including refilling the cleaning fluid), the new or refilled ink packs 310 may be connected in step S110. Then, step S112 and the following steps may be performed. Following these processes, the printer 10 is returned to the state where at least the portion of ink flow passage from the position facing the ink packs 310 to the position of the choke valve mechanism 900 is filled with ink supplied from the ink packs 310, and the remaining portion of the ink flow passage, including the recording head 810, is filled with cleaning fluid (distribution-purpose ink) with the hollow flow passages 335 being closed by the choke valve mechanism 900.

D. Alternative Embodiment

Note that the aspects of the invention are not limited to the embodiments described above, but they may be modified into various alternative embodiments without departing from the scope of the appended claims. The following alternative embodiments are, for example, applicable.

D1. First Alternative Embodiment

In the ink filling process of the second embodiment described above, the hollow flow passages 335 may be closed after the ink flow passage to the recording head 810 of the carriage 80 is filled with ink. However, as in the case of the second embodiment, when the hollow flow passages 335 are closed after the ink flow passage is filled with ink to the position of the choke valve mechanism 900, it is desirably possible to suppress a decrease in quality of ink. In addition, when the hollow flow passages 335 are closed before ink fills the ink flow passage to the recording head 810 of the carriage 80, it is desirably possible to suppress the occurrence of clogged nozzles 812 or ink leakage.

Furthermore, in the ink filling process of the second embodiment, after closing the hollow flow passages 335 by the choke valve mechanism 900 and performing vacuum operation by the vacuum pump 710, the hollow flow passages 335 are opened to thereby fill the ink flow passage with ink. However, the ink flow passage may be filled with ink in such a manner that vacuum operation is performed while the hollow flow passages 335 are opened.

D2. Second Alternative Embodiment

In the above embodiments, the configuration of the printer 10 is just illustrative, and another configurations may be employed. For example, it is not necessary that the motor driving circuit 42 (shown in FIG. 14) of the printer 10 includes the stepping motor driving circuit 45. The choking DC motor 910 may instead be driven by the DC motor driving circuit. In addition, the electric current applied to the choking DC motor 910 and the period of time during which the electric current is applied as shown in FIG. 16A and FIG. 16B are illustrative only and are not intended to limit the scope or meaning of the invention. Thus, the applied electric current or the applied period of time may be modified. Moreover, it is not necessary to apply an electric current during the period T2.

Furthermore, it is not necessary that the choke valve mechanism 900 is provided at the ink supply portion 330 but the choke valve mechanism 900 may be provided at any portion of the ink flow passage from the ink packs 310 to the recording head 810. In addition, the configuration of the choke valve mechanism 900 may employ any configuration as far as it can open and close the ink flow passage.

In addition, in the ink filling process of the above embodiments, the vacuuming of the ink flow passage is performed by the vacuum pump 710. However, when the printer 10 includes another pump that is able to vacuum the ink flow passage, the vacuum operation in the ink filling process may be performed by other pump. Furthermore, in the ink filling process, the head cap 740 need not be connected to the carriage 80.

In addition, the configuration of the carriage 80 in the above embodiments is illustrative and another configurations may be employed as the configuration of the carriage 80. For example, it is not necessary that the carriage 80 includes the gas recovery chambers 841 and 821, the hollow needle 852, the regulator valves 836, or the like.

Furthermore, in the above embodiments, the plurality of ink packs 310 respectively contain inks of mutually different colors, however, the plurality of ink packs 310 may contain inks of the same color.

D3. Third Alternative Embodiment

In the above embodiments, the upper housing 30 is pivotally connected to the main housing 20 but upper housing 30 may also be slidably connected to the main housing 20. By so doing, the ink packs 310 may be accommodated in the upper housing 30.

Figure 19:
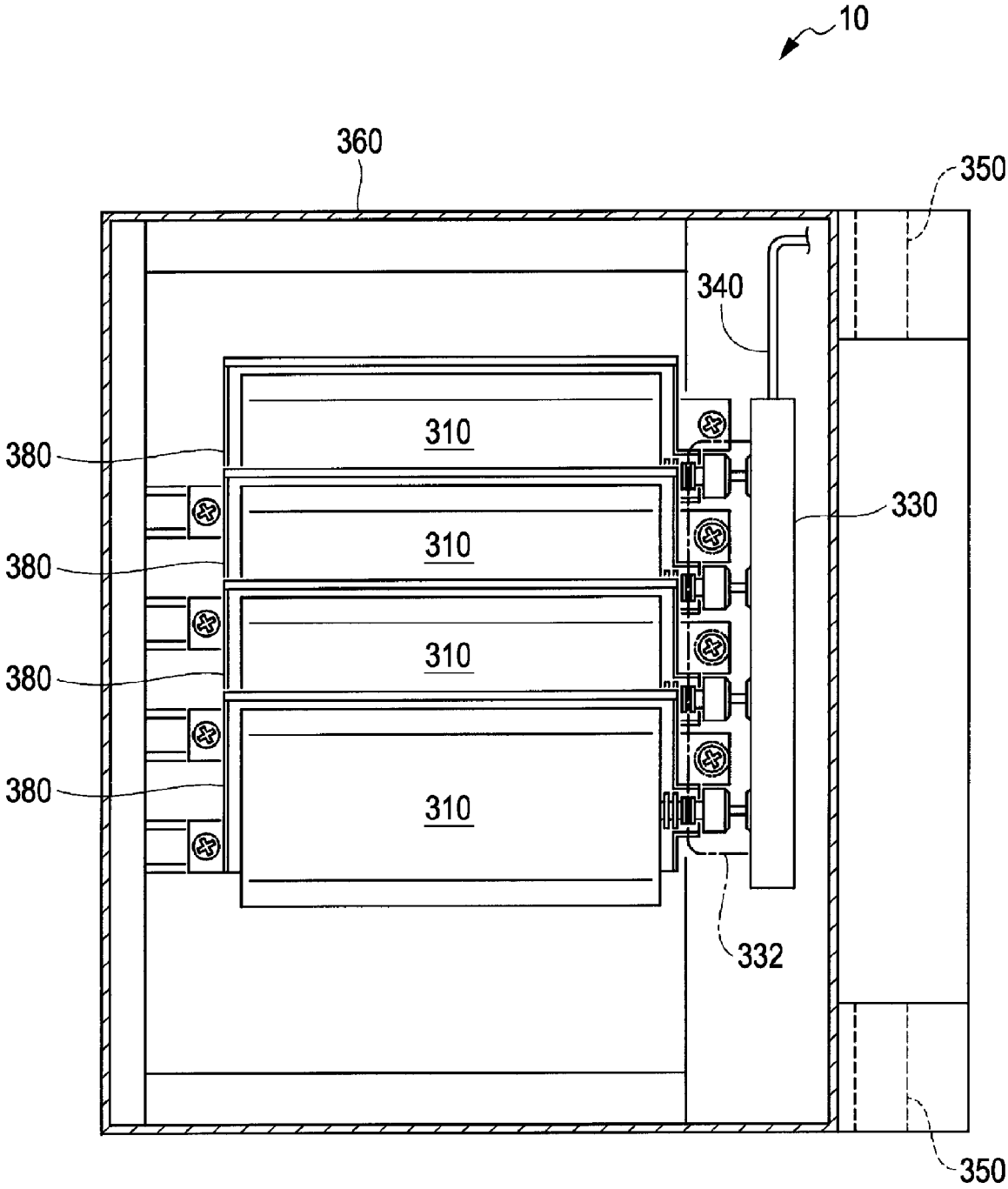
FIG. 19 is a top view that illustrates the inside of the upper housing according to an alternative embodiment.

In addition, in the above embodiments, the holders 380 may be arranged so that the orientation in which the holders 380 are arranged in the lower housing portion 360 is substantially aligned along the axial direction of the rotation shaft 350 as shown in FIG. 19.

According to the embodiment shown in FIG. 19, because the levels of the ink packs 310 held by the upper housing 30 are substantially the same between the closed state and the opened state, the pressure heads of inks contained in the respective ink packs 310 may be equalized. Thus, it is possible to improve the quality of ink ejected from the recording head 810.

Figure 20:
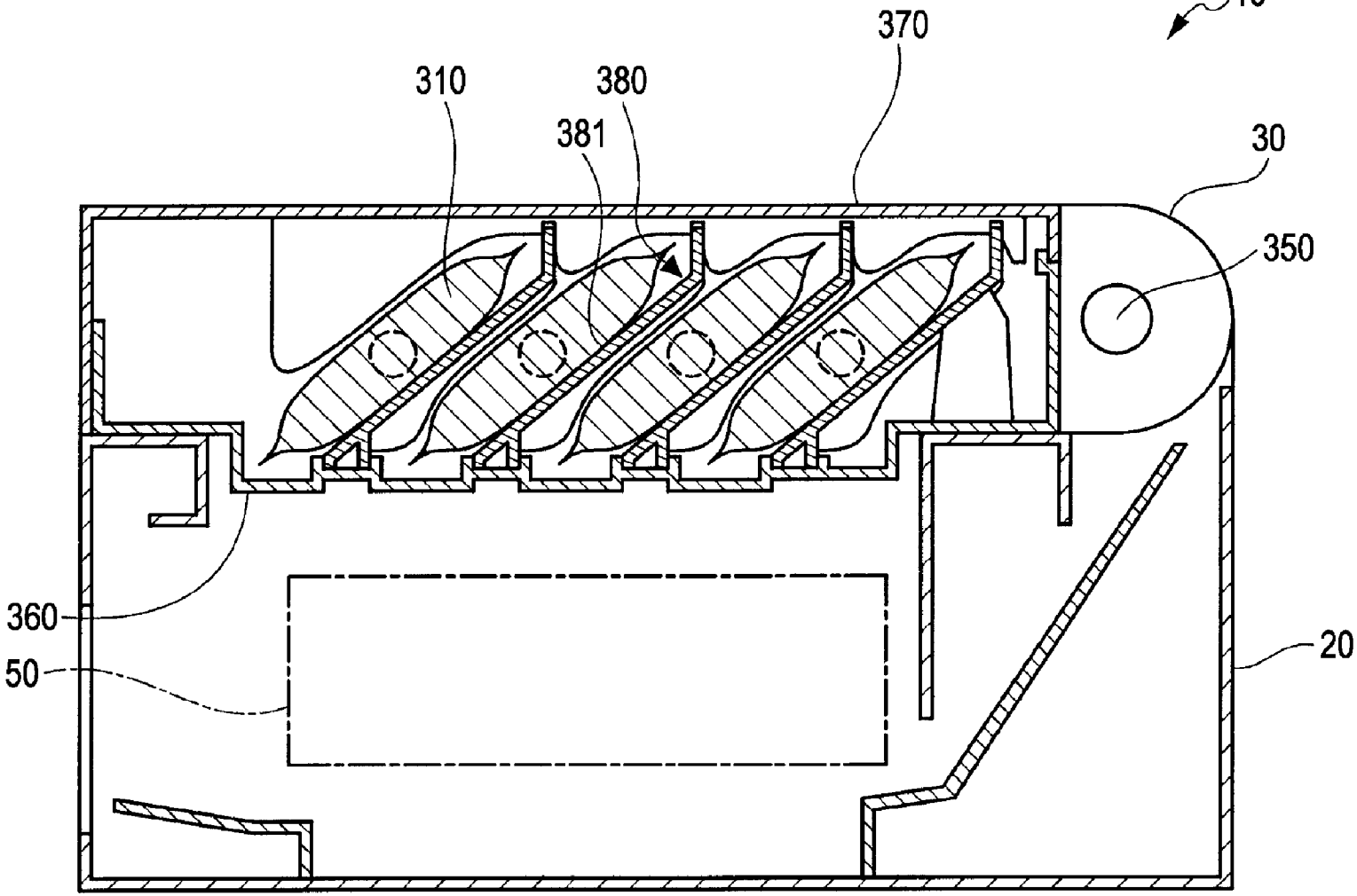
FIG. 20 is a cross-sectional view that illustrates a printer when the upper housing is closed according to an alternative embodiment.

In addition, as shown in FIG. 20, the holders 380 may be arranged so that the direction in which the inclined plates 381 are inclined is directed toward the rotation shaft 350. According to the embodiment of FIG. 20, wherein the holders 380 are arranged so that the inclined plates 381 are inclined in the opposite direction as shown in FIG. 2 and FIG. 3, the ink packs 310 may be mounted in a stable state by the inclined plates 381 of the holders 380 when the upper housing 30 is open.

D4. Fourth Alternative Embodiment

In the above described embodiment, the fluid ejecting apparatus is embodied as the ink jet recording apparatus, however, the invention is not so limited. The aspects of the invention may be embodied as a fluid ejecting apparatus that ejects or discharges fluid other than ink, such as liquids, including a liquid body in which particles of functional material are dispersed and a flowage body such as gel, or fluids other than liquid, such as solids that may be flowed and ejected.

For example, the aspects of the invention may be embodied as liquid ejecting apparatuses which eject a liquid body that contains materials such as electrode materials or color materials through dispersion or solution, for manufacturing a liquid crystal display, an electroluminescence (EL) display, a field emission display, or the like. The invention may also be embodied as a liquid ejecting apparatus which ejects a bio-organic material for manufacturing a bio-chip, or a liquid ejecting apparatus which ejects a sample of liquid in a precision pipette. Furthermore, the fluid ejecting apparatus may be a liquid ejecting apparatus that ejects a pinpoint quantity of lubricating oil to a precision machine, such as a clock, a watch or a camera, a liquid ejecting apparatus that ejects a transparent resin liquid, such as an ultraviolet curing resin, for forming a microscopic semi-spherical lens on a substrate (optical lens) used for an optical communication element, or the like, or in a fluid ejecting apparatus that ejects an etchant, such as acid or alkali, in order to perform etching on a substrate. The invention may also be embodied as a flowage ejecting apparatus that ejects a gel, or fine particle ejection recording apparatus that ejects solid, which is, for example, particles such as a toner. Thus, the aspects of the invention may be applied to any one of these ejecting apparatuses.

Furthermore, the ink may comprise water-based ink or an oil-based ink.

D5. Fifth Alternative Embodiment

Figure 21:
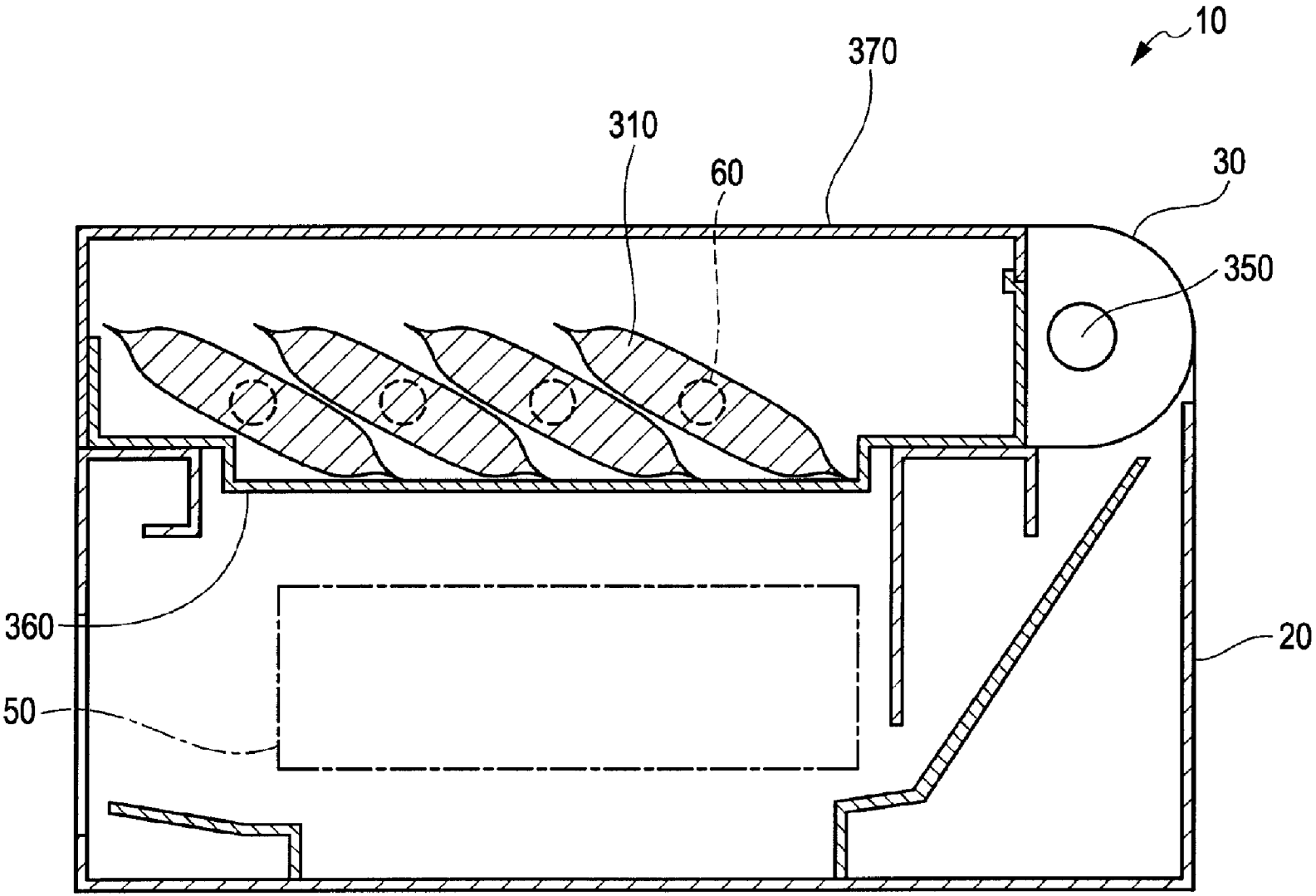
FIG. 21 is a cross-sectional view that illustrates a printer when the upper housing is closed according to an alternative embodiment.

FIG. 21 is a cross-sectional view that illustrates the printer 10 in a state where the upper housing 30 is closed according to an alternative embodiment. The alternative embodiment shown in FIG. 21 differs from the embodiment shown in FIG. 2 in the manner that the ink packs 310 are set. That is, the embodiment shown in FIG. 2 employs the manner in which the ink packs 310 are fixedly set to the holders 380 provided on the upper housing 30, whereas the alternative embodiment shown in FIG. 21 employs the manner in which no holders 380 are provided and the ink packs 310 are simply set in the upper housing 30. Thus, it is not necessary to use the holders 380 for setting the ink packs 310 in the upper housing 30, and the ink packs 310 may be directly mounted in the upper housing 30.

Figure 22:
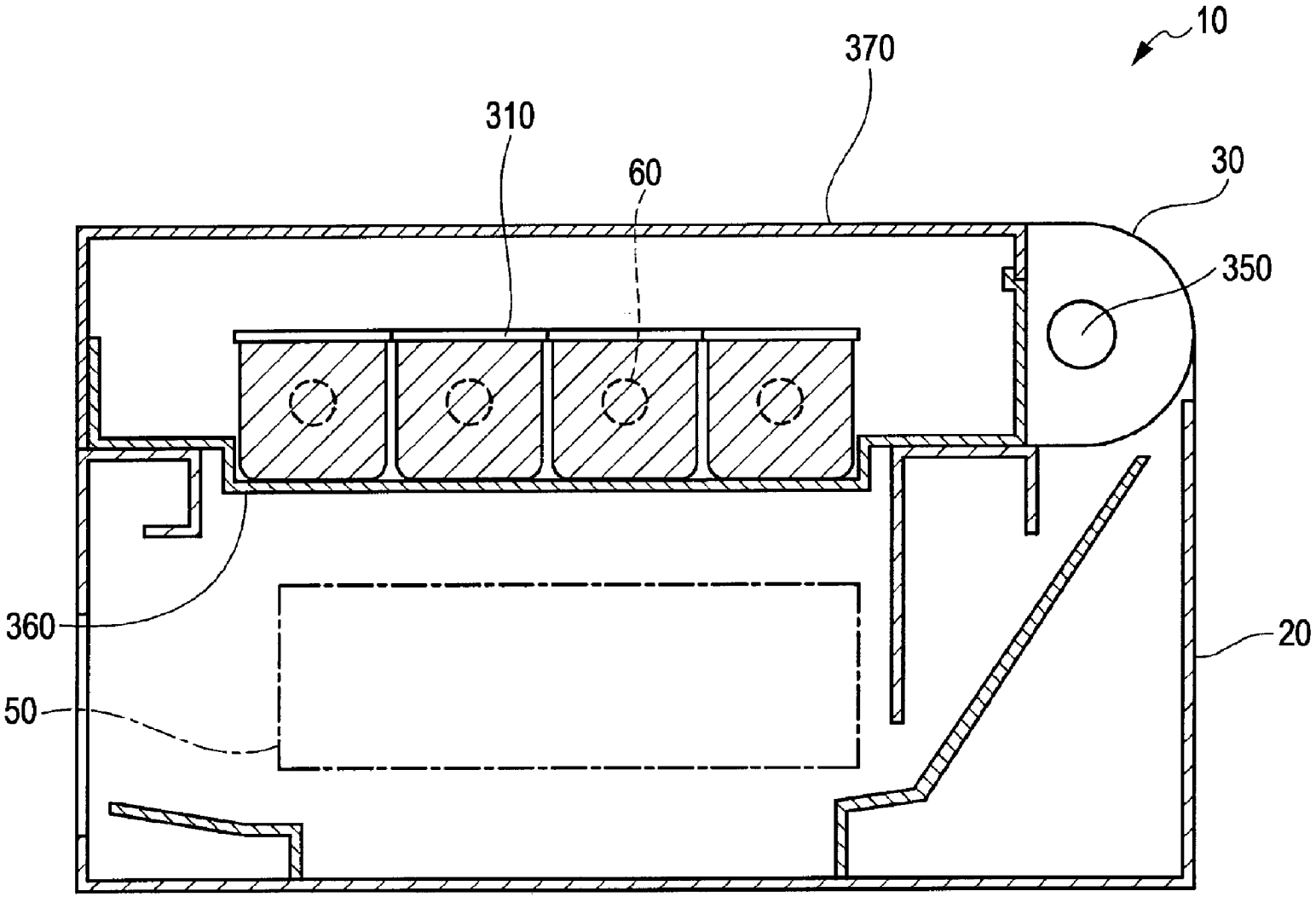
FIG. 22 is a cross-sectional view that illustrates a printer when the upper housing is closed according to an alternative embodiment.

FIG. 22 is a cross-sectional view that illustrates the printer 10 in a state where the upper housing 30 is closed according to an alternative embodiment. The alternative embodiment shown in FIG. 22 differs from the embodiment shown in FIG. 2 in the shape of each ink. That is, in the alternative embodiment shown in FIG. 22, box-shaped ink packs 310 are employed, and the ink packs 310 are directly mounted in the upper housing 30 as in the case of the alternative embodiment shown in FIG. 21. Thus, the shape of each ink pack is not limited to a bag shape formed of a flexible sheet but it may be another shape, such as a box shape.

Figure 23:
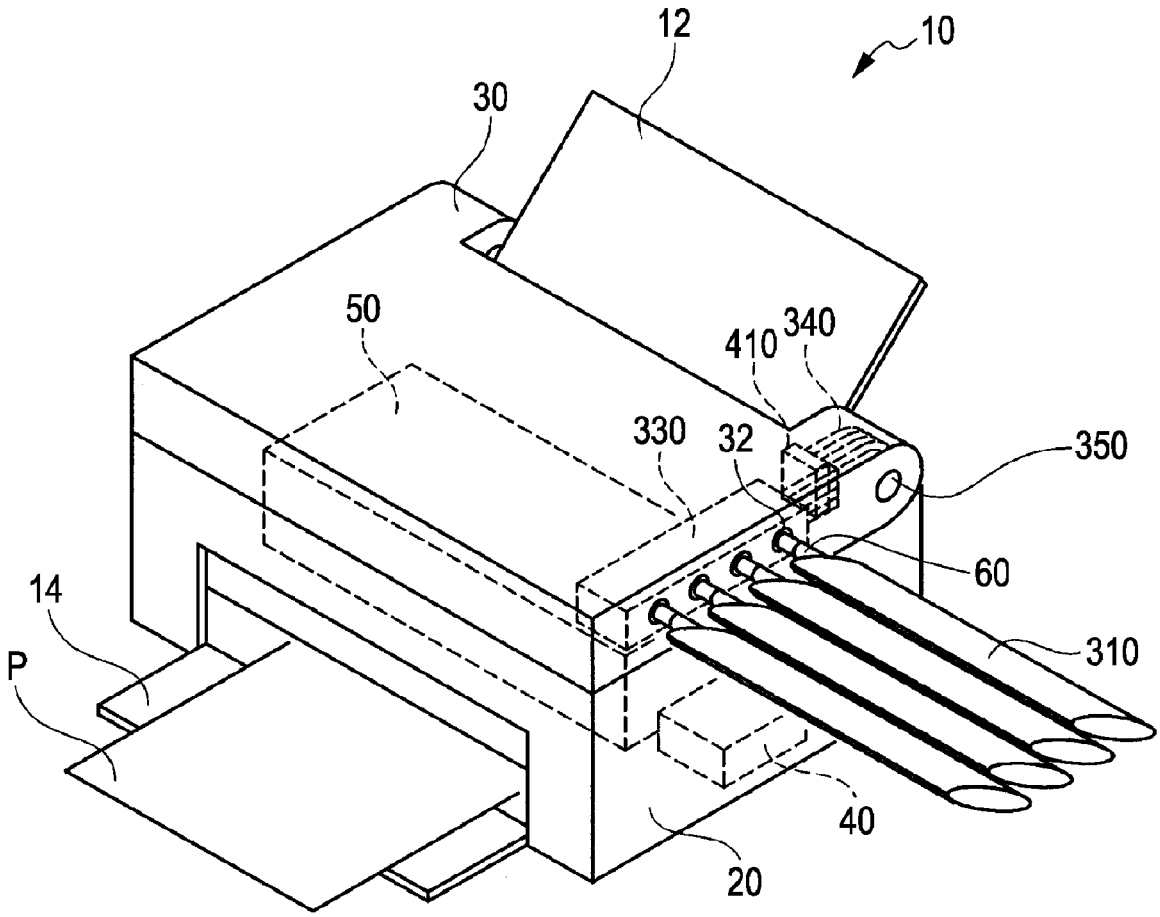
FIG. 23 is a perspective view that illustrates the configuration of a printer according to an alternative embodiment.

FIG. 23 is a perspective view that illustrates the configuration of the printer 10 according to an alternative embodiment. The alternative embodiment shown in FIG. 23 differs from the embodiment shown in FIG. 1 in the manner of setting the ink packs 310. That is, in the alternative embodiment shown in FIG. 23, the ink packs 310 are not accommodated inside the upper housing 30 but are arranged outside the printer 10. In the alternative embodiment shown in FIG. 23 as well, the pack ports 60 of the ink packs 310 are connected to the ink supply portion 330 through holes 32 formed in the upper housing 30. Thus, it is not necessary that the ink packs 310 are accommodated inside the upper housing 30 but they may be arranged outside the printer 10.

Figure 24:
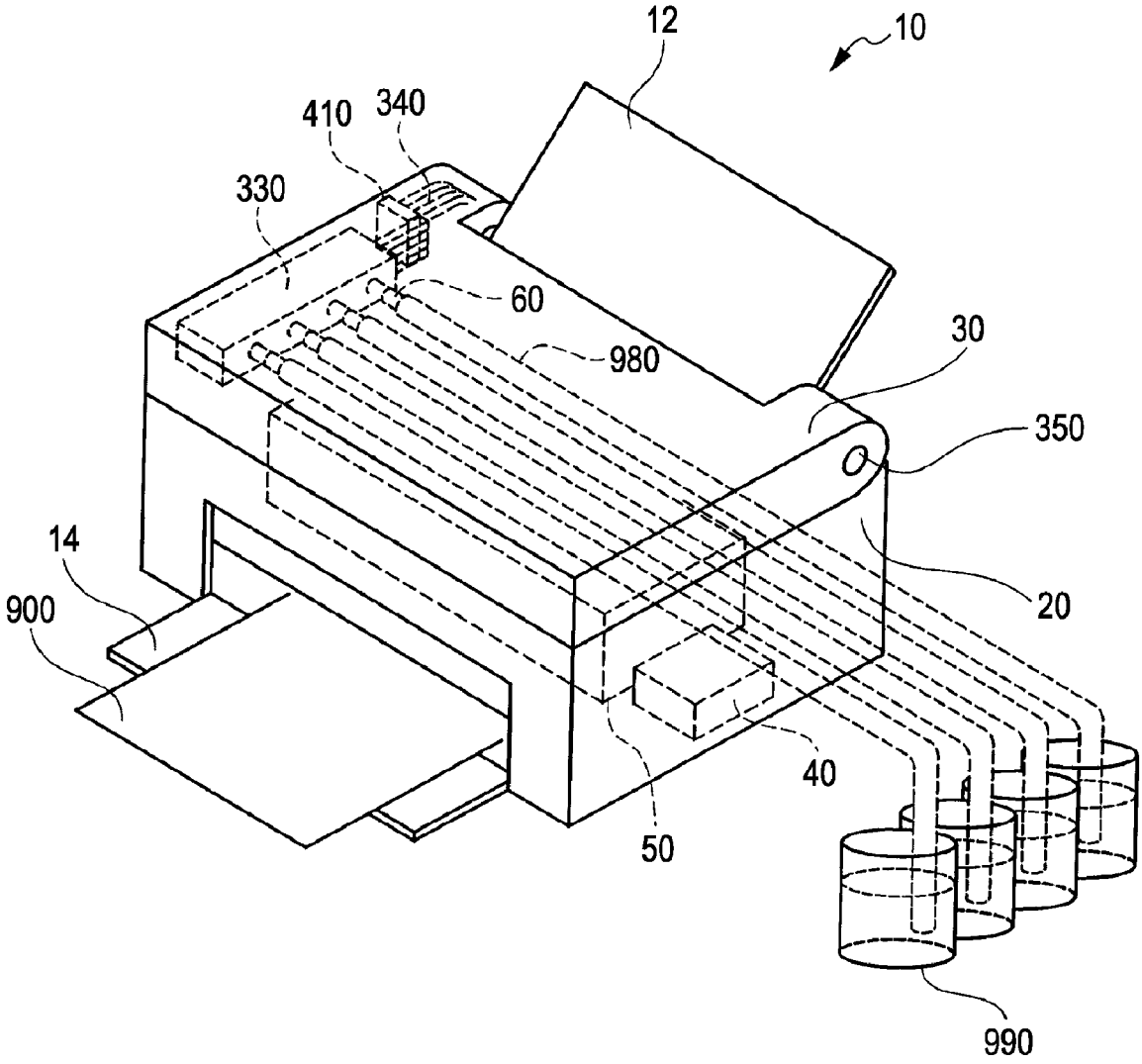
FIG. 24 is a perspective view that illustrates the configuration of a printer according to an alternative embodiment.

FIG. 24 is a perspective view that schematically illustrates the configuration of the printer 10 according to an alternative embodiment. The alternative embodiment shown in FIG. 24 differs from the embodiment shown in FIG. 1 in the manner of supplying ink to the printer 10. That is, in the alternative embodiment shown in FIG. 24, the pack ports 60 of the ink packs 330 are connected to the ink supply portion 330, and tubes 980 are provided between the pack ports 60 and ink tanks 990 that contain ink. The ink in the ink tanks 990 is supplied to the print mechanism portion 50 through the tubes 980, the pack ports 60, and the ink supply portion 330. The alternative embodiment shown in FIG. 24 may be implemented in such a manner that after ink in the ink packs 310 are used up, the ink packs 310 are removed except the pack ports 60 of the ink packs 310 and then the tubes 980 and the ink tanks 990 are set.

D6. Sixth Alternative Embodiment

In the ink filling process according to the third embodiment, cleaning fluid (distribution-purpose ink) is supplied to fill the ink supply system in the cleaning process (step S70), however, liquid other than the cleaning fluid (distribution-purpose ink) may be supplied to fill the ink supply system as far as the liquid does not contain a solid content. In addition, the third initial state may be a state in which the recording head 810 is filled with cleaning fluid (distribution-purpose ink) and the ink flow passage is not filled with cleaning fluid, or conversely may be a state in which the ink flow passage is filled with cleaning fluid and the recording head 810 is not filled with cleaning fluid.

D7. Seventh Alternative Embodiment

In the flowchart (FIG. 10 or FIG. 17) showing the ink filling process according to the first embodiment or the second embodiment, the cleaning process (steps S60 to S90 in FIG. 18) for the ink supply system is not shown. However, in the ink filling processes according to the first embodiment and the second embodiment, a similar cleaning process is performed before the processes shown in FIG. 10 and FIG. 17. However, the cleaning processes of the first embodiment and the second embodiment differs from that of the third embodiment in that cleaning fluid is not used for filling but is drained (see step S70 in FIG. 18). In addition, after the ink filling process according to the first embodiment shown in FIG. 10 or the ink filling process according to the second embodiment shown in FIG. 17 is completed, a so-called idle vacuuming operation (steps S154 and S155 in FIG. 18) may be performed as in the case of the third embodiment. In the first embodiment and the second embodiment, because the ink supply system is not filled with cleaning fluid during the cleaning process, a relatively large amount of liquid is not drained to the head cap 740 and, only a small amount of cleaning fluid that has remained in the ink supply system after completion of the cleaning process is drained through the idle vacuuming operation.

What is claimed is:

1. A fluid ejecting apparatus comprising:

a fluid containing portion that contains fluid;

a fluid discharging portion that is capable of discharging the fluid;

a flow passage forming portion that forms a fluid flow passage that extends from the fluid containing portion to the fluid discharging portion;

a valve mechanism that is capable of opening or closing the fluid flow passage, the valve mechanism having a DC motor that supplies power for opening and closing of the fluid flow passage; and a motor driving circuit that is configured to be used as a stepping motor and that drives the DC motor, the motor driving circuit being capable of applying a predetermined electric current to the DC motor through a terminal to cause the DC motor to open or close the valve mechanism;

wherein the fluid ejecting apparatus is placed in an initial state before an initial use of the fluid ejecting apparatus wherein the fluid is contained in the fluid containing portion, and at least a portion of the fluid flow passage from a position of the fluid containing portion to the position of the valve mechanism is filled with the fluid and the fluid flow passage is closed by the valve mechanism, wherein before initially using the fluid electing apparatus, after the fluid is filled in the fluid containing portion, the fluid flow passage is closed by the valve mechanism and the DC motor is connected to a terminal of the motor driving circuit.

2. The fluid ejecting apparatus according to claim 1, wherein, the fluid discharging portion is filled with preuse liquid during the initial state that does not contain a solid.

3. The fluid ejecting apparatus according to claim 1, wherein a portion of the fluid flow passage, other than the portion filled with the fluid, is filled during the initial state with a pre-use liquid that does not contain a solid.

4. The fluid ejecting apparatus according to claim 2, wherein the pre-use liquid is liquid that does not contain a color material as the solid.

5. The fluid ejecting apparatus according to claim 1, further comprising:

a vacuum device that is capable of vacuuming the inside of the fluid flow passage, wherein the initial state of the fluid ejecting apparatus is formed through a method comprising:

(a) closing the fluid flow passage using the valve mechanism;

(b) generating a negative pressure in the fluid flow passage from the fluid discharging portion to the position of the valve mechanism by vacuuming with the vacuum device;

(c) opening the fluid flow passage using the valve mechanism; and (d) closing the fluid flow passage using the valve mechanism when the fluid contained in the containing portion fills the fluid flow passage from the containing portion to the position of the valve mechanism.

6. The fluid ejecting apparatus according to claim 5, wherein the initial state of the fluid ejecting apparatus is formed through a method that comprises:

filling the fluid flow passage with the pre-use liquid and connecting the fluid containing portion to the fluid flow passage prior to initially closing the fluid flow passage.

7. The fluid ejecting apparatus according to claim 1, wherein before the initial use of the fluid ejecting apparatus, the fluid is contained in the containing portion and the fluid discharging portion is not filled with the fluid.

8. The fluid ejecting apparatus according to claim 1, wherein the fluid ejecting apparatus includes a plurality of containing portions that are capable of containing the fluid, and wherein the flow passage forming portion includes a plurality of fluid flow passages that are formed in correspondence with the plurality of fluid containing portions.

9. The fluid ejecting apparatus according to claim 1, further comprising a carriage that is capable of moving when the fluid discharging portion is mounted on the carriage, wherein the fluid containing portion is arranged at a position that is different from the position of the carriage.

10. The fluid ejecting apparatus according to claim 1, wherein the fluid is liquid ink.

11. A fluid ejecting apparatus comprising:

a fluid containing portion capable of containing a fluid;

a fluid discharging portion capable of discharging the fluid;

a flow passage that forms a fluid flow passage that extends from the fluid containing portion to the fluid discharging portion, wherein before initially using the fluid ejecting apparatus, fluid is filled in the fluid containing portion and at least a portion of the fluid flow passage from the location where the fluid flow passage is connected to the fluid containing portion is filled with the fluid;

a valve mechanism that is capable of opening and closing the fluid flow passage that has a DC motor that supplies power for opening and closing of the fluid flow passage; and a motor driving circuit that is configured to be used as a stepping motor and that drives the DC motor, the motor driving circuit being capable of applying a predetermined electric current to the DC motor through the terminal to cause the valve mechanism to open or close the valve mechanism, wherein before initially using the fluid ejecting apparatus, after the fluid is filled in the fluid containing portion, the fluid flow passage is closed by the valve mechanism and the DC motor is connected to a terminal of the motor driving circuit.

12. The fluid ejecting apparatus according to claim 11, wherein the motor driving circuit applies a first predetermined electric current in a first direction to open or close the fluid flow passage and applies another predetermined electric current in a second direction opposite to the first direction when the fluid flow passage is opened or closed.

13. The fluid ejecting apparatus according to claim 11, further comprising a carriage that is capable of moving when the fluid discharging portion is mounted on the carriage, wherein the fluid containing portion is arranged at a position that is different from the position on the carriage.

14. The fluid ejecting apparatus according to claim 11, wherein the fluid is liquid ink.

15. The fluid ejecting apparatus according to claim 11, further comprising:

a vacuum device that is capable of vacuuming the inside of the fluid flow passage, wherein before initially using the fluid ejecting apparatus, a negative pressure is generated in the fluid flow passage, causing the containing portion to fill the portion fluid flow passage.

16. The fluid ejecting apparatus according to claim 11, wherein, the fluid discharging portion is filled with preuse liquid that does not contain a solid.

17. The fluid ejecting apparatus according to claim 1, wherein the portion of the fluid flow passage that is not filled with the fluid is filled with a pre-use liquid that does not contain a solid.

* * * * *